US010441069B2

(12) United States Patent
Andersson

(10) Patent No.: US 10,441,069 B2
(45) Date of Patent: Oct. 15, 2019

(54) EXTENDABLE TABLE

(71) Applicant: IKEA Supply AG, Pratteln (CH)

(72) Inventor: Benny Andersson, Älmhult (SE)

(73) Assignee: IKEA Supply AG, Pratteln (CH)

( * ) Notice: Subject to any disclaimer, the term of this patent is extended or adjusted under 35 U.S.C. 154(b) by 0 days.

(21) Appl. No.: 15/757,531

(22) PCT Filed: Sep. 7, 2016

(86) PCT No.: PCT/EP2016/071065
§ 371 (c)(1),
(2) Date: Mar. 5, 2018

(87) PCT Pub. No.: WO2017/042203
PCT Pub. Date: Mar. 16, 2017

(65) Prior Publication Data

US 2018/0344023 A1 Dec. 6, 2018

(30) Foreign Application Priority Data

Sep. 7, 2015 (SE) ..... 1551138
Jul. 13, 2016 (SE) ..... 1651049
Jul. 25, 2016 (SE) ..... 1651085

(51) Int. Cl.
*A47B 1/10* (2006.01)
*A47B 1/08* (2006.01)
(Continued)

(52) U.S. Cl.
CPC ..... *A47B 1/10* (2013.01); *A47B 1/08* (2013.01); *A47B 88/402* (2017.01);
(Continued)

(58) Field of Classification Search
CPC ..... A47B 21/03; A47B 1/08; A47B 13/081
(Continued)

(56) References Cited

U.S. PATENT DOCUMENTS 1,071,006 A 8/1913 Little
2,441,721 A * 5/1948 Schroeder ..... A47B 96/027 108/102
(Continued)

FOREIGN PATENT DOCUMENTS

CA 2 437 147 A1 2/2005
CH 334 983 A 12/1958
(Continued)

OTHER PUBLICATIONS

Loehle et al. "Mixed Lubrication with C18 Fatty Acids: Effect of Unsaturation", Tribology Letters, 2014, vol. 53, pp. 319-328.
(Continued)

*Primary Examiner* — Jose V Chen
(74) *Attorney, Agent, or Firm* — Renner, Otto, Boisselle & Sklar, LLP

(57) ABSTRACT

An extendable table sliding system for an extendable table is provided. The sliding system includes at least two parts being moveable relative each other and together forming at least a part of the extendable table sliding system, wherein one of said at least two parts includes at least one sliding surface being coated with a lacquer including a resin, wherein said lacquer in turn is at least partly coated with a lipophilic composition coating to provide a slide layer with a lowered friction.

20 Claims, 9 Drawing Sheets

(51) Int. Cl.
*A47B 88/417* (2017.01)
*A47B 88/40* (2017.01)

(52) U.S. Cl.
CPC ..... *A47B 88/417* (2017.01); *A47B 2210/0021* (2013.01); *A47B 2210/0029* (2013.01)

(58) Field of Classification Search
USPC ..... 108/102, 143, 137, 83, 69
See application file for complete search history.

(56) References Cited

U.S. PATENT DOCUMENTS

| | | | | | |
|---|---|---|---|---|---|
| 2,720,316 | A * | 10/1955 | Glascott | A47B 61/003 | 108/102 |
| 3,139,313 | A | 6/1964 | Rule | | |
| 3,221,677 | A * | 12/1965 | Kerr | A47B 45/00 | 108/102 |
| 3,760,744 | A * | 9/1973 | Cruckshank | A47B 1/08 | 108/102 |
| 3,916,802 | A * | 11/1975 | Virtue | A47B 45/00 | 108/102 |
| 4,036,369 | A * | 7/1977 | Eisenberg | A47B 45/00 | 108/102 |
| 4,138,176 | A | 2/1979 | Cowdroy | | |
| 4,286,525 | A * | 9/1981 | Willmore | A47B 1/08 | 108/102 |
| 4,297,952 | A * | 11/1981 | Zagaroli | A47B 1/02 | 108/65 |
| 4,500,146 | A * | 2/1985 | Peterson | A47B 45/00 | 108/102 |
| 4,713,949 | A * | 12/1987 | Wilcox | A47B 45/00 | 108/102 |
| 5,101,524 | A | 4/1992 | Brandschain | | |
| 5,263,384 | A * | 11/1993 | Suzuki | G02B 21/26 | 108/137 |
| 5,290,058 | A * | 3/1994 | Adams | A61G 7/0527 | 108/143 |
| 5,735,610 | A | 4/1998 | Mark et al. | | |
| 6,520,092 | B2 * | 2/2003 | Marshall | B25H 5/00 | 108/137 |
| 6,854,402 | B2 * | 2/2005 | DuBarry | A47B 1/08 | 108/137 |
| 6,877,826 | B2 * | 4/2005 | Wood | A47B 45/00 | 108/110 |
| 7,398,737 | B1 * | 7/2008 | Martellaro | B60N 3/001 | 108/143 |
| 7,780,254 | B2 * | 8/2010 | Wang | H05K 7/1489 | 108/143 |
| 7,987,799 | B2 * | 8/2011 | Lange | A47B 45/00 | 108/102 |
| 10,077,934 | B1 * | 9/2018 | Dizon | F25D 3/06 | |
| 2003/0213698 | A1 | 11/2003 | Kawagoshi et al. | | |
| 2004/0096129 | A1 | 5/2004 | Schmalzhofer | | |
| 2008/0159671 | A1 | 7/2008 | Leonardelli | | |
| 2014/0255656 | A1 | 9/2014 | Suzuki et al. | | |
| 2015/0361274 | A1 | 12/2015 | Domes et al. | | |
| 2016/0106221 | A1 | 4/2016 | Gardner | | |
| 2016/0319211 | A1 | 11/2016 | Barth et al. | | |

FOREIGN PATENT DOCUMENTS

| | | | |
|---|---|---|---|
| CN | 104154118 | A | 11/2014 |
| DE | 1112266 | B | 8/1961 |
| DE | 3613313 | A1 | 10/1987 |
| DE | 29611949 | U1 | 9/1996 |
| DE | 29813478 | U1 | 11/1998 |
| DE | 20111930 | U1 | 10/2001 |
| DE | 10 2011 053 946 | A1 | 3/2013 |
| FR | 1467583 | A | 1/1967 |
| GB | 1126855 | A | 9/1968 |
| GB | 1415100 | A | 11/1975 |
| GB | 2 386 929 | A | 10/2003 |
| JP | 576447 | | 3/1993 |
| JP | 2003268194 | | 9/2003 |
| JP | 2006-062328 | A | 3/2006 |
| WO | 1999047824 | A1 | 9/1999 |
| WO | 2006022669 | A1 | 3/2006 |
| WO | 2015051892 | A1 | 4/2015 |
| WO | 2017042201 | A1 | 3/2017 |
| WO | 2017042228 | A1 | 3/2017 |
| WO | 2017044032 | A1 | 3/2017 |
| WO | 2017044034 | A1 | 3/2017 |

OTHER PUBLICATIONS

Greenlaw, "I use coconut oil instead of a spray lubricant as much as possible, especially near food", Pi nterest 11I , 'Nov. 1, 2014 (Nov. 1, 2014)' XP055315462, Retrieved from the Internet: URL:https:jjnl.pinterest.com/pin/395331673512857041/[retrieved on 20:1.6-11-01].

International Search Report and Written Opinion for corresponding International Application No. PCT/EP2016/071065 dated Nov. 14, 2011.

International Preliminary Report on Patentability corresponding International Application No. PCT/EP2016/071065 dated Oct. 12, 2017.

International Search Report and Written Opinion for copending International Application No. PCT/EP2016/071104 dated Nov. 16, 2011.

International Preliminary Report on Patentability copending International Application No. PCT/EP2016/071104 dated Oct. 12, 2017.

International Search Report and Written Opinion for copending International Application No. PCT/SE2016/050837 dated Nov. 23, 2016.

International Preliminary Report on Patentability copending International Application No. PCT/SE2016/050837 dated Oct. 13, 2017.

International Search Report and Written Opinion for copending International Application No. PCT/SE2016/050835 dated Nov. 23, 2016.

nternational Search Report and Written Opinion for copending International Application No. PCT/EP2016/071059 dated Dec. 5, 2016.

* cited by examiner

EXTENDABLE TABLE

This application is a national phase of International Application No. PCT/EP2016/071065 filed Sep. 7, 2016, and claims priority to Swedish Application No. 1551138-9 filed on Sep. 7, 2015, Swedish Application No. 1651049-7 filed on Jul. 13, 2016 and Swedish Application No. 1651085-1 filed on Jul. 25, 2016, which are incorporated herein by reference.

TECHNICAL FIELD

The present invention relates to an extendable table. More particularly the present invention relates to an extendable table sliding system for use with an extendable table, as well as an extendable table having such sliding system.

BACKGROUND

Extendable tables have existed for a long time and various extension techniques have been suggested in order to provide for a robust, yet easily maneuverable, solution. For example it is common to pivotally connect the longitudinal edges of the table surface to a main central portion. A moveable frame member, e.g. a bar pivoting in a horizontal plane or a bar sliding in the horizontal plane, can be positioned to support the foldable edges of the table surface for extending the table. When a more compact table is desired, the longitudinal edges of the table surface can be lifted slightly upwards in order to allow for retraction of the moveable frame member. When the edges of the table surface are released downwards they will pivot fully downwards to rest in a position where they extend in a vertical direction downwards.

Another known example of extendable tables is based on an insert. The table surface is for this type of extendable table divided into two parts being pushed towards each other to form a single table surface. Both parts of the table surface are supported by an underlying extendable table sliding system. This extendable table sliding system is a sliding structure so that when the table is to be extended the two parts of the table surface can be pulled away from each other leaving a gap in between. In this gap an insert can be positioned, while also the insert is supported by the underlying extendable table sliding system. The insert forms an intermediate table surface portion, being aligned with the two original table surface parts so to form a continuous, and extended, table surface.

The first example of prior art is suffering from the obvious drawback of that when the table is in its compacted position the area between the legs are covered by the pivoted edges of the table surface. This means that a person cannot sit comfortably at the edge as his or hers legs cannot be positioned under the table surface.

In the other example mentioned above the extendable table sliding system is normally based on wood members sliding relative each other. Although a simple and cost effective solution is provided the friction between the wooden parts is often causing a severe problem for a person trying to pull the two table surface parts away from each other. The problem may be even worse when the two table surface parts are pushed against each other. In order to solve this problem there has been suggested low friction solutions requiring moveable sliding members, such as guide rollers etc., but these types of components suffer from a high cost.

In view of the problems mentioned there is a need for an improved extendable table which allows for a simple and cost effective structure and manufacturing, while still allowing for easy operation and maneuver by a person using the table.

SUMMARY

An object of the present invention is to provide an extendable table sliding system for an extendable table overcoming the above mentioned drawbacks of prior art and at least partly solving the problems associated with the prior art systems.

This object is achieved by utilizing a novel concept for extendable table sliding systems, and to provide an extendable table operating according to this concept. The novel concept is based on the principle of having a sliding surface with very low sliding friction. The sliding surface is coated with a lacquer comprising a resin. The lacquer is in turn at least partly coated with a lipophilic composition coating to provide a slide layer with lowered friction. The sliding surface may for example be formed on an aluminum bar, e.g. aluminum profile, preferably having an anodized oxide surface layer, onto which the lacquer is applied. As an example, the surface may be formed on a linear, aluminum profile having been electrophoretically, preferably anaphoretically coated with an acrylic resin and subsequently heat cured to form the lacquer coated on the slide surface. Preferably, the aluminum profile has an anodized oxide surface layer onto which the lacquer is applied. The Honny process or one of its derivatives may be used to obtain such anodized, lacquered surfaces. Whereas the thickness of the anodized oxide surface layer preferably is at least 5 micrometers, the thickness of the lacquer coated on the slide bar may preferably be 100 micrometers or less. The lipophilic composition coating typically comprises compounds comprising C6 to C40, such as C8 to C30, non-aromatic hydrocarbyl groups, such as alkenyl groups and/or alkyl groups, e.g. alkyl groups.

According to another embodiment the slide surface of the slide member is made from steel, onto which the lacquer is applied. Steel is a generally strong, hard and comparably cheap material that can be used as a starting material for the slide member. Steel surfaces may be lacquered by electrocoating or autodeposition in a bath to provide a lacquer layer with uniform thickness. Steel surfaces may also be lacquered by wet spraying.

The linear slide bar is arranged to be in sliding engagement with at least one sliding member. The interface between the slide layer of the slide bar and the sliding member forms a linear plain bearing to allow for linear movement of the sliding member along the longitudinal axis of the linear slide bar. The part of said sliding member to slide over the slide layer may be configured as a blade extending in the sliding direction. The blade provides for a well-defined point of contact and a low friction. Further, the slide layer may be present in a groove extending along the longitudinal axis of the slide bar. The sliding member comprises at least one individual contact point in contact with the slide bar at the interface between the slide bar and the sliding member. The contact area of each individual contact point may be less than 3 $mm^2$. Further, the contact pressure in the at least one contact point may be at least 4 $N/mm^2$.

According to a first aspect of the invention, an extendable table sliding system for an extendable table is provided. The sliding system comprises at least two parts being moveable relative each other and together forming at least a part of an extendable table sliding system for said table, wherein one of said at least two parts comprises at least one sliding surface being coated with a lacquer comprising a resin. The lacquer is in turn at least partly coated with a lipophilic composition coating to provide a slide layer with a lowered friction.

The sliding surface may preferably be provided on a rigid member having a fastening arrangement adapted for connection to one of said parts being moveable relative each other for allowing linear movement of said part along a longitudinal axis.

The sliding surface may be formed on at least one surface of a C-shaped groove. According to one embodiment the C-shaped groove may be integrally formed in one of said at least two parts.

The sliding surface may be formed by an insert received in a recess in one of said at least two parts.

The part being provided with the recess may be made of a material being different from the material of said insert.

The material of the part being provided with the recess may be a wooden material, or a plastic material. Within this specification, the term "wooden material" is used broadly to cover various types of wood-based material commonly used for furniture manufacturing. More specifically "wooden material" includes wood (natural wood or also in the form of plywood), chipboard, particle board, cardboard, fibre board, such as High Density Fibre board (HDF) and Medium Density Fibre board (MDF). "Chipboard" is also used to refer to any composite materials manufactured by mixing wood particles of any shape with adhesives, independent of the product's shape, including for example oriented strand board.

The sliding surface may be formed by a member protruding outwards from one of said at least two parts.

The sliding surface may be formed by at least one of an upper sliding surface, a lower sliding surface, and a distal sliding surface, or any combination thereof.

The other one of said parts may be provided with at least one sliding member, and wherein the interface between the sliding surface and the at least one sliding member forms a linear plain bearing to allow for a relative linear movement of the sliding member along the longitudinal axis of the sliding surface. The relative linear movement of the sliding member means that the sliding member may move and the sliding surface may be stationary, or it may be the opposite, i.e. that the sliding surface is moving and the sliding member is held stationary, or both the sliding member and the sliding surface may be moving.

At least the part of said at least one sliding member being in contact with the sliding surface may be made of a plastic, preferably a plastic comprising a polymer with polar groups, more preferably the polar groups are selected from the group consisting of hydroxyl groups, carboxylic acid groups, amide groups, halide groups, sulfide groups, cyano groups (nitrile groups), carbamate groups, aldehyde groups, and/or ketone groups.

At least the part of said at least one sliding member in contact with the sliding surface may be made of a plastic comprising a polymer selected from the group of polymers consisting of polyoxymethylenes (POM), polyesters (e.g. thermoplastic polyesters, such as polyethylene terephthalate (PET), polytrimethylene terephthalate (PTT), polybutylene terephthalate (PBT), and polylactic acid (PLA), as well as bio-based thermoplastic polyesters, such as polyhydroxyalkanoates (PHA), polyhydroxybutyrate (PHB), and polyethylene furanoate (PEF)) polyamides (PA), polyvinyl chloride (PVC), polyphenylene sulfide (PPS), polyaryletherketone (PAEK; e.g. Polyether ether ketone (PEEK)), and Polytetrafluoroethylene (PTFE). These types of plastics have a high mechanical strength and interact in an efficient manner with the lipophilic composition on the lacquer.

The at least one sliding member may in its entirety be made from a plastic.

The part of said at least one sliding member arranged to slide along the sliding surface may comprise at least one blade extending in the sliding direction.

The sliding member may be provided with at least one blade extending in a first direction from a first surface, and at least one blade extending in a second direction from a second surface, wherein said first and second surfaces are parallel, and wherein said first direction is opposite to said second direction.

The sliding member may be provided with at least one blade extending in a first direction from a first surface, and at least one blade extending in a third direction from a third surface, wherein said first and third surfaces are non-parallel, and wherein said first direction is perpendicular to said third direction.

The at least one sliding member may comprise at least one individual contact point in contact with the sliding surface, the contact area of each individual contact point being less than 3 $mm^2$, more preferably less than 1.5 $mm^2$, and most preferably less than 0.75 $mm^2$.

The at least one sliding member may comprise at least one contact point at which contact is made between the sliding member and the sliding surface, wherein the contact pressure in said at least one contact point is at least 4 $N/mm^2$, preferably at least 8 $N/mm^2$, and more preferably at least 12 $N/mm^2$, and wherein preferably the contact pressure is lower than the strain at yield of the material of the sliding member at the contact point.

The at least one sliding member be provided with at least one dowel for attaching said sliding member to an associated part.

The at least one sliding member may be formed as a groove extending along the sliding direction.

The sliding surface may be made from a material having a Vickers hardness of at least 50 MPa, more preferably at least 100 MPa, and most preferably at least 150 MPa, such as metal or glass, preferably the material is a metal.

The sliding surface may be made of aluminum and/or steel.

The sliding surface may be made of aluminum, e.g. a linear aluminum profile. According to one embodiment the sliding surface is made of aluminum having an anodized oxide surface layer onto which the lacquer is applied, preferably the thickness of the anodized oxide surface layer is at least 5 micrometers, more preferably at least 10 micrometers. Aluminum is a material providing a good support for the sliding surface. An anodized aluminum surface provides for an even harder support for the lacquer, thereby reducing friction further.

The resin of the lacquer may comprise polar groups, such as hydroxyl groups, carboxylic acid groups, amide groups, cyano groups (nitrile groups), halide groups, sulfide groups, carbamate groups, aldehyde groups, and/or ketone groups. These types of lacquer give low friction and efficient and strong interaction with the lipophilic composition.

The resin of the lacquer may be a thermosetting resin. An advantage of a thermosetting resin is that it provides for a hard and durable lacquer, thereby supporting low friction and long life.

The resin of the lacquer may be selected from the group consisting of: acrylic resins, acrylate resins, acrylamide resins, methacrylate resins, methyl metachrylate resins, acrylonitrile resins, styrene-acrylonitril resins, acrylonitrile styrene acrylate resins, reaction products or a mechanical mixture of alkyd resin and water-soluble melamine resin, reaction products or a mechanical mixture of a vinyl-modified unsaturated alkyd resin and a water-soluble melamine resin, and polymers and mixtures of one or several of these resins. This type of resin provides for a hard lacquer and strong interaction with the lipophilic composition.

The resin of the lacquer may be an acrylic resin, such as an acrylate resin, preferably an acrylic resin chosen among: a acrylate resin, an acrylamide resin, a methacrylate resin, or a methyl metachrylate resin and mixtures thereof.

The sliding surface may have been lacquered by electrocoating or autodeposition in a bath containing the lacquer or by electrostatic coating with a powder lacquer, or by wet spraying of a lacquer; preferably the sliding surface has been lacquered by electrocoating or autodeposition in a bath containing the lacquer or lacquered by electrostatic coating with a powder lacquer.

The thickness of the lacquer coated on the sliding surface may be 100 μm or less, preferably 75 μm or less, more preferably 50 μm or less. A relatively thin layer of the lacquer has been found to reduce the friction.

The thickness of the lacquer coated on the sliding surface may be 5 to 75 μm, preferably 10 to 50 μm, more preferably 15 to 40 μm. These thickness ranges have been found to provide a good combination of low friction and long life.

The sliding surface may be formed by an aluminum member, e.g. an aluminum profile, preferably having an anodized oxide surface layer, onto which the lacquer is applied, preferably the thickness of the anodized oxide surface layer is at least 5 micrometers, more preferably at least 10 micrometers, and wherein the anodized oxide surface layer has been electrophoretically, such as anaphoretically, coated with a resin, such as an acrylic resin, and subsequently heat cured to form the lacquer coated on the sliding surface, preferably the sliding surface has been coated using the Honny process or one of its derivatives.

The lipophilic composition coating may comprise compounds comprising C6 to C40, such as C8 to C30, or even C10 to C24, non-aromatic hydrocarbyl groups, such as alkenyl groups and/or alkyl groups, e.g. alkyl groups.

In an embodiment the lipophilic composition coating present on the lacquer comprises at least 25 wt. %, such as at least 50 wt. %, of compounds comprising C6 to C40, such as C8 to C30, alkyl groups.

The lipophilic composition coating present on the lacquer may comprise at least 25 wt. %, such as at least 50 wt. %, C6 to C40, such as C8 to C30, non-aromatic hydrocarbons, such as alkenes and/or alkanes, e.g. alkanes.

The lipophilic composition coating present on the lacquer may comprise triglycerides and/or fatty acids; preferably said triglycerides, if present, are composed of saturated fatty acids residues and said fatty acids, if present, are saturated fatty acids.

The lipophilic composition coating present on the lacquer may comprise 1 to 40 wt. % triglycerides and/or fatty acids, preferably said triglycerides, if present, to at least 90% being composed of fatty acids with C6 to C40, such as C8 to C30, alkyl groups, and preferably said fatty acids, if present, having C6 to C40, such as C8 to C30, alkyl groups.

The lipophilic composition coating present on the lacquer may comprise at least 25 wt. %, such as at least 50 wt. %, of triglycerides and/or fatty acids, preferably said triglycerides, if present, to at least 90% being composed of fatty acids with C6 to C40, such as C8 to C30, alkyl groups, and preferably said fatty acids, if present, having C6 to C40, such as C8 to C30, alkyl groups, preferably said lipophilic composition is not only composed of fatty acids.

According to a second aspect, an extendable table is provided. The extendable table comprises at least one sliding system according to the first aspect.

One of said two parts of the extendable table sliding system may be fixed to the table, while the other of said at least two parts forms an extendable part of the extendable table sliding system of the table.

Each one of said two parts may comprise two parallel members, and wherein one parallel member of each one of the two parts forms a first sliding system, and the other parallel member of each one of the two parts forms a second sliding system.

The two parallel members of each one of said two parts may be fixedly attached to each other by means of a transverse beam.

A table surface may be fixedly attached to one of said at least two parts.

A table surface may be releasably attached to one of said at least two parts.

BRIEF DESCRIPTION OF DRAWINGS

The invention will be described in further detail below under reference to the accompanying drawings, in which.

DETAILED DESCRIPTION

Figure 1A:
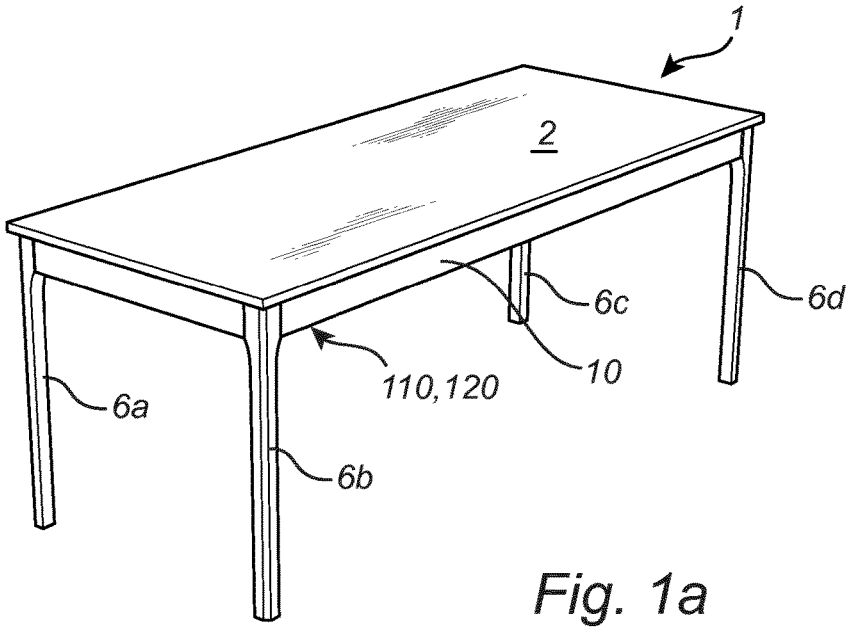
FIG. 1*a* is an isometric view of an extendable table according to an embodiment, shown in a compacted state.
Figure 1B:
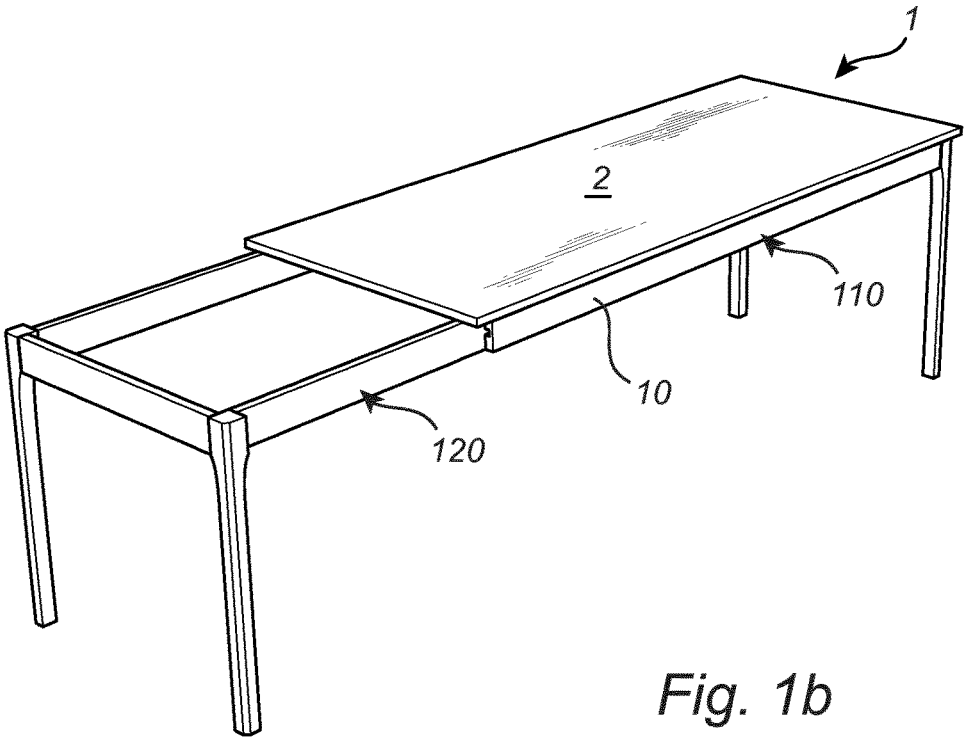
FIG. 1*b* is an isometric view of the extendable table shown in FIG. 1*a*, here shown in a semi-finished extended state.
Figure 1C:
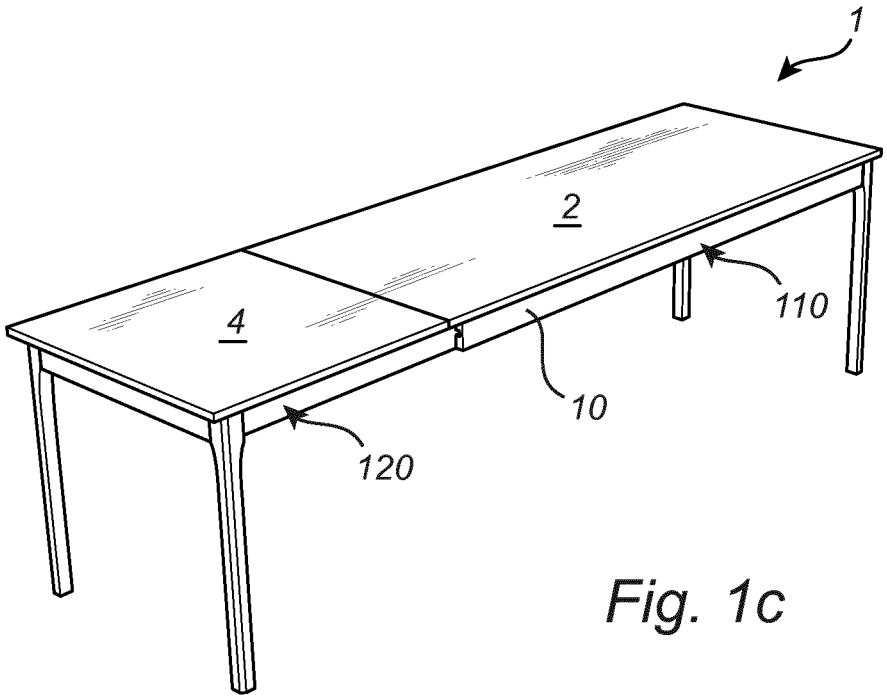
FIG. 1*c* is an isometric view of the extendable table shown in FIGS. 1*a* and 1*b*, here shown in a finished extended state.

Starting in FIGS. 1*a-c* the transformation of an extendable table 1 according to an embodiment is shown in three consecutive states. In FIG. 1*a* the table 1 is shown in a compacted state, in FIG. 1*b* the table 1 is shown in a semi-finished extended state, and in FIG. 1*c* the table 1 is shown in a finished extended state.

As seen in the drawings the table 1 comprises a table surface 2 being fixed to an extendable table sliding system 10. The extendable table sliding system 10 is extendable, as is particularly shown in FIG. 1*b*, so that an additional extension table surface 4 could be releasably positioned on top of the extended extendable table sliding system 10 adjacent to the fixed table surface 2. This is shown in FIG. 1*c*.

Preferably the table surfaces 2, 4 are supported by four legs 6*a-d*, each leg 6*a-d* being positioned at a respective corner of the table surface 2, 4. As is shown in FIGS. 1*a-c* the legs 6*a-d* are connected to the extendable table sliding system 10 so that the legs 6*a-d* along with the extendable table sliding system 10 forms the entire support for the table surfaces 2, 4.

The extendable table sliding system 10 comprises a fixed part 110 and a movable part 120. The fixed part 110 may be securely attached to the table surface 2 so that there can be no relative movement between the fixed part 110 and the table surface 2. On the other hand the moveable part 120 of the extendable table sliding system 10 is moveable relative the table surface 2, and hence also relative the fixed part 110 of the extendable table sliding system 10, in a sliding manner. Two legs 6*a-b* form a first leg pair being fixedly connected to the moveable part 120 of the extendable table sliding system 10. Importantly for this particular embodiment but not for all embodiments, these legs 6*a-b* cannot be attached to the table surface 2 as this would prevent movement of the moveable part 120 relative to the table surface 2. The opposite legs 6*c-d* form a second leg pair being fixedly connected to the fixed part 110 of the extendable table sliding system 10. These legs 6*c-d* may or may not be directly attached to the table surface 2, as their position relative the table surface 2 anyhow is permanent due to the connection between the table surface 2 and the fixed part 110 of the extendable table sliding system 10.

Figure 2:
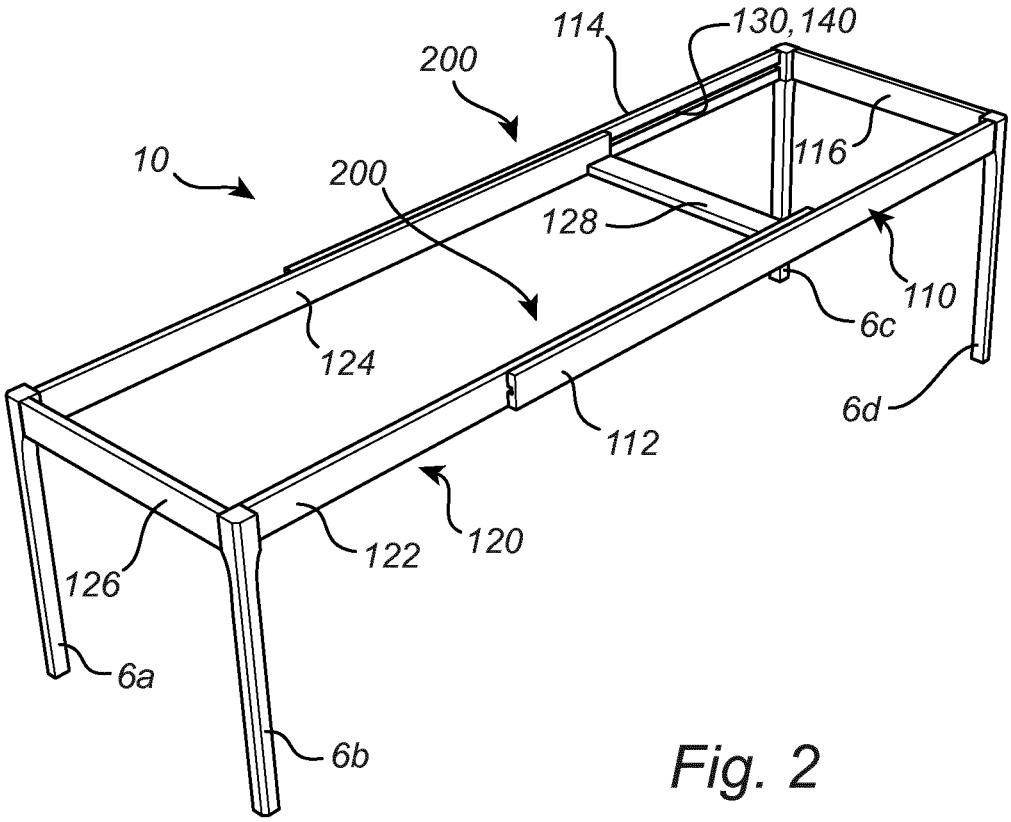
FIG. 2 is an isometric view of an extendable table sliding system according to an embodiment.

In FIG. 2 an example of the extendable table sliding system 10 is shown, and in particular details of the configurations of the fixed part 110 and the moveable part 120. The extendable table sliding system 10 is in this drawing shown in an extended state for supporting not only the table surface 2, but also the additional table surface 4. Hence the extendable table sliding system 10 is positioned in the same position as is shown in FIGS. 1*b* and 1*c*.

The fixed part 110 forms a rim for the table surface (not shown). The fixed part 110 comprises two parallel members 112, 114 being interconnected at some position along their respective length, such as at one of their respective ends, by a traverse beam 116. The traverse beam 116 is preferably arranged perpendicularly to the two parallel members 112, 114, and the legs 6*c*, 6*d* are securely positioned in the interface between the traverse beam 116 and the respective member 112, 114. The parallel members 112, 114 are preferably of the same length which may be selected to correspond to the length of the table surface 2, or slightly less than that. Each parallel member 112, 114 forms part of a respective sliding system 200 as will be described in more detail below. When in use the table surface 2 is arranged on top of the parallel members 112, 114 and the traverse beam 116, and the table surface 2 may be securely attached to these members 112, 114, 116 by screws, adhesive, etc.

The moveable part 120 forms a rim for the additional table surface (see FIG. 1*c*) when the moveable part 120 is pulled out from the fixed part 110. Similarly to the fixed part 110, the moveable part 120 comprises two parallel members 122, 124 being interconnected at some position along their respective length, such as at one of their respective ends, by a traverse beam 126. The traverse beam 126 is preferably arranged perpendicularly to the two parallel members 122, 124, and the legs 6*a*, 6*b* are securely positioned in the interface between the traverse beam 126 and the respective member 122, 124. Optionally an additional cross beam 128 is provided at the opposite ends of the parallel members 122, 124 in order to prevent any angular displacement of these members 122, 124. In use the cross beam 128 will also provide robustness to the fixed part 110, as seen in FIG. 2. The members 112, 114 on the other hand may receive horizontal support by being mounted to the table surface 2.

The parallel members 122, 124 are preferably of the same length which may be selected to correspond to the length of the additional table surface 4 but with a certain extension so that there is an overlap between the parallel members 122, 124 of the moveable part 120 and the parallel members 112, 114 of the fixed part 110 when the extendable table sliding system 10 is in its most extended position. Each parallel member 122, 124 also forms part of the respective sliding systems 200 as will be described in more detail below. As the sliding systems 200 are similar, although mirrored as can be seen from FIG. 2, the same reference numeral 200 is used to denote both sliding systems.

When the moveable part 120 is positioned in the extended state as is shown in FIG. 2 the additional table surface 4 may be arranged on top of the parallel members 122, 124 and the traverse beam 126 as is shown in FIG. 1*c*. The additional table surface 4 may be aligned and releasably secured to these members 122, 124, 126 e.g. by a pin/recess interface or similar, as is per se know in the art. Such interface could be implemented by providing the underside of the additional table surface 4 with small recesses at certain distances in between, while the upper edge of the parallel members 122, 124 and/or the traverse beam 126 is provided with corresponding protruding pins arranged at the same distances in between. Other solutions for aligning and releasably securing the additional table surface 4 to the extended extendable table sliding system 10 are of course also possible.

The distance between the two parallel members 122, 124 of the moveable part 120 of the extendable table sliding system 10 is selected so that the two parallel members 122, 124 may slide at a side of the two parallel members 112, 114 of the fixed part 110 of the extendable table sliding system 10. In the shown example the parallel members 122, 124 of the moveable part 120 run on the inside of the two parallel members 112, 114 of the fixed member 110. However in an alternative embodiment the two parallel members 112, 114 of the fixed part 110 could of course be arranged on the inside of the two parallel members 122, 124 of the moveable part 120.

As can be seen in FIG. 2 the functionality of the extendable table 2 is based on the fact that the extendable table sliding system 10 supporting the table surfaces 2, 4 takes benefit from a sliding system 200 capable of extending the length of the entire extendable table sliding system 10 so that additional table surfaces can be added while still being fully supported by the extended extendable table sliding system 10.

The sliding system 200 requires that at least one sliding surface is moveable relative at least one sliding member. In the embodiment shown in FIG. 2, the parallel members 112, 122 form a first sliding system 200, while the parallel members 114, 124 form a similar, although mirrored, second sliding system 200. Hence one parallel member 112, 114 of each of the first and second sliding system 200 is provided with a sliding surface, while one parallel member 122, 124 is provided with a sliding member. As will be further explained in the following the sliding surface forms part of a sliding bar, i.e. acting as a guiding member, which in use provides a very low friction in a very cost-efficient manner.

Again referring to FIG. 2, for the embodiments described herein the parallel members 112, 114 of the fixed part 110 of the extendable table sliding system 10 are configured to comprise either the sliding surface, i.e. the slide bar, or the sliding member(s), while the parallel members 122, 124 of the moveable part 120 of the extendable table sliding system 10 are configured to comprise the other one of the sliding surface, i.e. the slide bar, or the sliding member(s). While still giving reference to FIG. 2 it can be seen that the parallel members 112, 114 of the fixed part 110 of the extendable table sliding system 10, i.e. the parallel members 112, 114 forming a respective slide bar, are equipped with a respective sliding surface 140 in the form of a groove 130 extending along the longitudinal direction of the members 112, 114. The groove 130 has a certain height and depth in order to accommodate one or more sliding members (not shown in FIG. 2 but described in detail hereinafter) provided on the mating surface of the two parallel members 122, 124 of the moveable part 120 of the extendable table sliding system 10.

In order to provide the members 112, 114 serving as slide bars or guiding members with a respective sliding surface 140, at least a part of the members 112, 114 are lacquered with a lacquer comprising a resin. In the present embodiment, and as will be further explained below, the lacquer is provided on an insert 142 received in the groove 130. Further, the lacquer is at least partly coated with a lipophilic composition to lower the sliding resistance, i.e. the friction. It has surprisingly been found that coating a surface lacquered with a resin, for example an acrylic resin, with a lipophilic composition, such as for example sebum (natural or artificial), coconut oil or liquid paraffin, provides a slide layer with extremely low friction (sliding resistance). The application of the lipophilic composition reduces the dynamic friction with as much as 75%. Further, and even more surprisingly, the effect is not temporarily, but seemingly permanent or at least very long-lasting. The need to replenish the lubricant may hence be dispensed with.

In experiments employing aluminum profiles having been anaphoretically coated with an acrylic resin subsequently heat cured to form a lacquer (cf. the Honny process, initially disclosed in GB 1,126,855), wherein the lacquer of the aluminum profiles was coated with sebum, the friction remained nearly the same after more than 70,000 test cycles of a sliding door being reciprocated along the profile. So many cycles by far exceed the expected number on lifetime cycles. Further, washing the coated aluminum profile with water/detergent, ethanol, and/or iso-propanaol didn't affect the friction. Without being bond to any theory, it seems that the sebum coating provides an irreversibly bound lubricant coating on top of the lacquer comprising the acrylic resin. Further, the lacquer seems to be important in providing low friction.

According to an embodiment there is thus provided an extendable table sliding system having at least two parts 110, 120 being moveable relative each other and together forming at least a part of an extendable table sliding system 10 for a table 1, wherein one of said at least two parts 110, 120 comprises a sliding surface 140 coated with a lacquer comprising a resin. The lacquer is in turn at least partly coated with a lipophilic composition coating to provide a slide layer with lowered friction. By coating the lacquer, the sliding friction is not just temporarily lowered, but long term low sliding friction is obtained. As already explained the lubricating coating may be permanent, or at least having a very long life, dispensing with the need to replenish the lubricating coating. Further, very low amounts of the lipophilic composition are needed to provide lowered friction. Thus, contamination of the lubricating coating does not pose any pronounced problem, as the coating, due to the very low amount present, does not have substantial adhesive properties. This is in contrast to the normal use of lubricants in plain bearings. Further, exposure to contaminations, e.g. dust etc., has been shown not to affect the lowered friction. Neither is the lubricating coating sensitive to washing. Wiping the sliding surface 140 with a dry and/or wet cloth, does not affect the lowered friction.

Such a low amount of the lipophilic composition coating is needed, that the lipophilic composition may be applied to a sliding member rather than to the sliding surface 140. In sliding over the sliding surface 140, the lipophilic composition will be transferred from the sliding member to the sliding surface 140 to provide a lipophilic composition coating. Hence, the lipophilic composition coating could be applied to the sliding surface 140, to the sliding member, or to both of them.

According to an alternative embodiment a slide member is a sliding part whose slide layer, having a similar composition as the slide layer described hereinbefore, is arranged to slide along the longitudinal axis of a linear slide profile, e.g. a plastic profile, to form a linear plain bearing. At least the sliding surface of the sliding part may, according to one embodiment, be an aluminum surface, preferably having an anodized oxide surface layer, onto which the lacquer is applied. The thickness of such preferable anodized oxide surface layer is preferably at least 5 micrometers, more preferably at least 10 micrometers. Further, the thickness of the anodized layer may be less than 250 micrometers, such as less than 100 micrometers or less than 50 micrometers. An unduly thick anodized layer increases the cost of production without substantially further reducing the friction. While the sliding surface 140 preferably is formed on an aluminum profile, preferably provided with an aluminum oxide layer, also other materials coated with a lacquer comprising a resin may be considered. In order to allow for long term use and to carry loads, the sliding surface 140 is typically made from a hard material, such as metal or glass. Especially the surface of the slide member should preferably be hard. The Vickers hardness of the material from which the sliding surface 140 is made, may be at least 50 MPa, more preferably at least 100 MPa, still more preferably at least 150 MPa, and most preferably at least 300 MPa. According to an embodiment, the sliding surface 140 is formed on a metal bar, such as an aluminum bar or a steel bar. While it is preferred if an aluminum member has an oxide layer, also a raw, i.e. not oxidized, lacquered aluminum member may be used. It is however preferred if the surface of the aluminum member is oxidized to provide the aluminum member with a hard oxide surface layer.

The sliding surface 140 may be formed on an aluminum bar or member. Further, the surface of the aluminum bar or member coated with the lacquer may be an aluminum oxide layer. The thickness such of oxide layer may be at least 5 micrometers, more preferably at least 10 micrometers. Further, the thickness of the oxide layer may be less than 250 micrometers, such as less than 100 micrometers or less than 50 micrometers. As known in the art, the durability and hardness of the surface of aluminum profiles may be improved by oxidation due to the properties of aluminum oxide. The oxide layer initially provided by anodically oxidation is porous. While the pores may be closed by steam treatment, sealing via anaphoretically coating with an acrylic resin subsequently heat cured to form the lacquer, is even more effective in sealing the porous aluminum oxide layer: This method, firstly disclosed by Honny Chemicals Co. Ltd. (cf. GB 1,126,855), is often referred to as the Honny process.

Further, compared to plastic sliding surface, a hard, stiff bar, such as aluminum or steel bar, may accept far more heavy loads and still provide low friction.

In addition, it has been found that a relatively high contact pressure in the contact between the sliding surface 140 and the sliding member reduces the friction. For this reason as well it is beneficial to make the sliding surface 140 from a hard material, such as aluminum or steel, since such materials can accept higher contact pressures, thereby reducing friction. The low friction also at high contact pressure is an advantageous property for an extendable table with parallel sliding members, as prior art assemblies with two parallel members slidingly movable relative to two other parallel members often get stuck even if only slightly tilted.

According to an embodiment, the low friction sliding surface 140 is formed on a linear, aluminum profile. Preferably, the linear aluminum profile is oxidized (e.g. anodized) in order to increase the hardness of the surface. The profile is typically anaphoretically coated with an acrylic resin subsequently heat cured, thereby providing a linear sliding surface 140 having lacquered slide surface. The aluminum profile may be anodized to obtain an anodized layer thickness of at least 5 micrometers, more preferably at least 10 micrometers, prior to application of the resin of the lacquer. Further, thickness of the anodized layer may be less than 250 micrometers, such as less than 100 micrometers or less than 50 micrometers. Such profiles may be obtained via the Honny process (cf. above) or one of its derivatives. Typically, the Honny process is used to provide white, glossy profiles. However, neither the Honny process nor the present embodiments are limited to white profiles. The preferable feature is that the lacquer obtained in this manner is hard, thin, has good adhesion to the surface to which it is applied, has an even thickness, and is suitable for being coated with the lipophilic composition coating.

As known in the art, various resins, e.g. thermosetting resins, may be used to lacquer aluminum bars and other bars, i.e. to form a lacquer on aluminum bars and other bars. Further, thermosetting resins may also be used to lacquer other metal members, e.g. a sliding member made of steel. The lacquer comprises a resin. As known to the skilled person, a lacquer is a hard, thin coating. The resin of the lacquer may for this application preferably comprise polar groups, such as hydroxyl groups, carboxylic acid groups, amide groups, cyano groups (nitrile groups), halide groups, sulfide groups, carbamate group, aldehyde groups, and/or ketone groups. Further may the resin of the lacquer be a thermosetting resin.

Examples of resins for lacquering metal comprise acrylic resins and polyurethane resins. According to an embodiment, the resin is an acrylic resin, such as an acrylate resin, an acrylamide resin, a methacrylate resin, or a methyl metachrylate resin, and mixtures thereof. According to another embodiment, the resin is a polyurethane resin. The acrylic resin may be a thermosetting resin.

According to another embodiment, the resin of the lacquer is selected from the group consisting of: acrylic resins, acrylate resins, acrylamide resins, methacrylate resins, methyl metachrylate resins, acrylonitrile resins, styrene-acrylonitril resins, acrylonitrile styrene acrylate resins, reaction products or a mechanical mixture of alkyd resin and water-soluble melamine resin, reaction products or a mechanical mixture of a vinyl-modified unsaturated alkyd resin and a water-soluble melamine resin, and polymers and mixtures of one or several of these resins.

Further, the thermosetting resin may the reaction product or a mechanical mixture of an alkyd resin and water-soluble melamine resin, or of a vinyl-modified unsaturated alkyd resin and a water-soluble melamine resin, the water-soluble melamine resin being obtained from hexamethylol melamine hexaalkylether. Vinyl modified unsaturated alkyd resins may be made by polymerization of a vinyl monomer with an alkyd resin composed of an unsaturated oil or fatty acid. As known to the skilled person, the term "vinyl monomer" relates to a monomer having a vinyl group (—CH═CH2) in the molecule, such as an acrylic ester, for example methyl acrylate and ethyl acrylate, a methacrylic ester, for example methyl methacrylate and hydroxyethyl methacrylate, an unsaturated, organic acid, for example acrylic acid and methacrylic acid, and styrene.

Processes for obtaining thermosetting acrylic resins are well-known to the skilled person. As an example, they may be obtained by heating and stirring a mixture consisting of organic solvents, such as methanol, ethylene glycol, monobutyl ether, and/or cyclohexanone, unsaturated organic acids, such as acrylic acid, methacrylic acid, and/or maleic anhydride, a cross-linking vinyl monomer (as defined above), such as methylol-acrylamide and/or methylol methacrylamide, a polymerizable vinyl monomer, such as styrene and/or acrylic acid ester, polymerization catalysts, such as benzoyl peroxides and/or lauroyl peroxides, and polymerization regulators, such as dodecyl mercaptan and/or carbon tetrachloride, to carry out polymerization, thereafter neutralizing the product with, for example, an aqueous solution of ammonia and/or triethylamine to make the resin soluble in water. Further, as known to the skilled person, thermosetting resins composed of alkyd resins and water-soluble melamine resin may be obtained from hexamethylol melamine hexaalkyl ether, may be obtained by mixing a water-soluble melamine resin at a temperature of from room temperature to 100° C. with an alkyd resin modified with a fatty acid, the alkyd resin having an acid value of from 10 to 80 and being obtained by heating a mixture consisting of (1) a saturated or unsaturated aliphatic acid, (2) ethylene glycol, glycerol, polyethylene glycol, other polyhydric alcohol or an epoxide, (3) adipic acid, sebacic acid, maleic anhydride or other polybasic acid or anhydride, and (4) a small quantity of cyclohexanone, toluene or other organic solvent. Thermosetting resins may also be obtained by mixing a water-soluble melamine resin and an alkyd resin from the ester exchange process, the resin being obtained by esterifying a mixture of dehydrated castor oil, an above-mentioned polyhydric alcohol and a small amount of an ester exchanging catalyst such as caustic potash, and thereafter esterifying also an above-mentioned polybasic acid or anhydride. As further known to the skilled person, thermosetting resins consisting of a modified acrylic resin and a water-soluble melamine resin, obtained from hexamethylol melamine hexaalkyl ether, may be obtained by polymerising by heating and stirring a mixture consisting of organic solvents, such as methanol, ethylene glycol, monobutyl ether and/or cyclohexanone, unsaturated acids, such as acrylic acid and/or methacrylic acid, a vinyl monomer (as hereinabove defined), such as styrene and/or acrylic acid ester, a cross-linking vinyl monomer, if necessary, such as methylol, is normally used. Good results may be obtained by using a concentration of resin of from 5 to 20% by weight and by regulating the voltage and the initial current density within a safe and economical range.

As known to the skilled person further resins for use in lacquering metal surfaces are known in the art. As an example, the resin of the lacquer may be selected from the group consisting of cationic epoxy electrocoat, epoxy and polyester resins, and polyester resins. Still further, lacquers adapted for autodeposition coating, such as Autophoretic™ coatings (e.g. Aquence™ Autophoretic® 866™ and BONDERITE® M-PP 930™, the latter being an epoxy-acrylic urethane) available from Henkel AG, DE, may also be used in lacquering surfaces comprising iron.

The slide surface 140 may be lacquered by electrocoating involving dipping a metal bar into a bath containing the lacquer and applying an electric field to deposit lacquer onto the metal bar acting as one of the electrodes. Further, the lacquer may be provided in powder form or in liquid form. Both powder and liquid lacquers may be sprayed onto the slide surface 140 to coat it. For powder lacquers, electro static coating may be used. For liquid lacquers a wet spray application or application in a bath may be used. Further, liquid lacquers in a bath may apart from electrocoating be applied by autodeposition.

In order to provide low friction, the thickness of the lacquer should be as even as possible. Thus it may be preferred to apply the lacquer by an electrocoating process, e.g. anaphoretic coating (cf. the Honny method) or cataphoretic coating, providing very even coatings. There are two types of electrocoating, i.e. anodic and cathodic electrocoating. Whereas the anodic process was the first to be developed commercially, the cathodic process is nowadays more widely used. In the anodic process, a negatively charged material is deposited on the positively charged component constituting the anode. In the cathodic process, positively charged material is deposited on the negatively charged component constituting the cathode. In the art, cathodic electrocoating is also known as cathodic dip painting (CDP), cathodic dip coating, cataphoretic coating, cataphoresis and cathodic electrodeposition. Further, the electrocoating process may also be referred to by the trade names of the bath material used. Examples include Cathoguard (BASF), CorMax (Du Pont), Powercron (PPG) and Freiotherm (PPG). Further, also electrostatically coating by powder lacquers or autodepostion in bath provide even coatings and may thus be used.

In lacquering steel surfaces, autodeposition may be used. As recognized by the skilled person, one of the important steps in autodeposition is the coating bath itself, where water-based paint emulsion at low solids (usually around 4-8% by weight) is combined with two other products. A "starter" solution of acidified ferric ($Fe^{3+}$) fluoride initiates the coating reaction and an oxidizing product stabilizes the metal ions in the solution. The coating emulsion is stable in the presence of ferric ions, but unstable in the presence of ferrous ions ($Fe^{2+}$). Therefore, if ferrous ions are liberated from the metal substrate, localized paint deposition will occur on the surface immersion of a component made from ferrous metal (e.g. steel) into an autodeposition bath causes the acidic environment to liberate ferrous ions, thereby causing the coating emulsion to be deposited, forming a mono-layer of paint particles. Henkel Adhesive Technologies (US)/Henkel AG & Co. KGaA (Germany) provides coatings under the trademark BONDERITE® for use in autodeposition.

As the lacquer coated on the sliding surface 140 typically is more compressible than the material of the sliding surface 140 itself, and as load carrying sliding member will apply pressure on the lacquer in sliding over the sliding surface 140, the thickness of the lacquer preferably is to be kept thin to reduce compression of it. Compressing the lacquer may negatively affect the sliding resistance; especially at the start of the sliding sequence, i.e. when the sliding member starts to move along the sliding surface 140 from a previous state of being at rest. According to an embodiment, the thickness of the lacquer coated on the sliding surface 140 is thus 100 μm or less, preferably 75 μm or less, more preferably 50 μm or less. Further, the thickness of lacquer coated on the sliding surface 140 may be 5 to 75 μm, such as 10 to 50 μm, or 15 to 40 μm. Layers of these thicknesses have been found to provide for efficient sliding behavior, also at the instance when the sliding member starts to move along the sliding surface 140.

Not only the low dynamic friction provided by the present sliding surface 140, but also the low difference between the static and dynamic friction provided by the present sliding surface 140 is beneficial in terms of the sliding behavior.

In order to reduce the friction of the sliding surface 140, the sliding surface 140 is, at least partly, coated with a lipophilic composition coating to provide a slide layer. Further, while various components may be present in the lipophilic composition coating present on the lacquer, the composition typically comprises components with intermediate to long carbon chains, e.g. carbon chains having a carbon atom length of C6 or more, such as C8 or more. Thus, the lipophilic composition coating may comprise compounds comprising C6 to C40, such as C8 to C30 or even C10 to C24, non-aromatic hydrocarbyl groups. Typical examples of such non-aromatic hydrocarbyl groups are alkenyl groups and alkyl groups, e.g. alkyl groups. Examples of compounds comprising such non-aromatic hydrocarbyl groups are:

- C6 to C40 non-aromatic hydrocarbons, such as alkenes and/or alkanes, e.g. alkanes;
- tri-glycerides, e.g. triglycerides comprising C6 to C40, such as C8 to C30, non-aromatic hydrocarbyl groups triglycerides; and
- fatty acids, e.g. C6 to C40, such as C8 to C30, carboxylic acids, and esters thereof, such as alkyl esters of fatty acids, e.g. methyl esters.

As known to the skilled person and as recognized in IUPAC's gold book (International Union of Pure and Applied Chemistry, Compendium of Chemical Terminology—Gold Book, Version 2.3.3 of 2014 Feb. 24):

- hydrocarbon denotes compounds consisting of carbon and hydrogen only;
- hydrocarbyl denotes univalent groups formed by removing a hydrogen atom from a hydrocarbon;
- alkane denotes acyclic branched or unbranched hydrocarbons having the general formula $C_nH_{2n+2}$;
- alkene denotes acyclic branched or unbranched hydrocarbons having one or more carbon-carbon double bond (s);
- alkyl denotes a univalent group derived from alkanes by removal of a hydrogen atom from any carbon atom —$C_nH_{2n+1}$;
- alkenyl denotes an univalent group derived from alkenes by removal of a hydrogen atom from any carbon atom;
- fatty acid denotes an aliphatic monocarboxylic acid;
- triglyceride denotes an ester of glycerol (propane-1,2,3-triol) with three fatty acids (tri-O-acylglycerol); and non-aromatic denotes a compound not comprising any cyclically conjugated molecular entity with increased stability due to delocalization.

According to an embodiment, the lipophilic composition coating present on the lacquer comprises at least 1 wt. % such as at least 5 wt. %, 10 wt. %, 25 wt. %, 50 wt. %, 60 wt. %, 70 wt. %, 75 wt. %, 80 wt. %, 85 wt. % or at least 90 wt. % of compounds comprising C6 to C40, such as C8 to C30, alkyl groups. Thus, the lipophilic composition coating may comprise least 1 wt. % such as at least 5 wt. %, 10 wt. %, 25 wt. %, 50 wt. %, 60 wt. %, 70 wt. %, 75 wt. %, 80 wt. %, 85 wt. % or at least 90 wt. % C6 to C40, such as C8 to C30, alkenes and/or alkanes, e.g. alkanes. Further, the lipophilic composition coating present on the lacquer may comprise least 1 wt. % such as at least 5 wt. %, 10 wt. %, 25 wt. %, 50 wt. %, 60 wt. %, 70 wt. %, 75 wt. %, 80 wt. %, 85 wt. % or at least 90 wt. % triglycerides and/or fatty acids (or alkyl esters thereof).

Whereas fatty acids have been found to improve the lubricating effect of mixtures of alkanes, such as liquid paraffin, they are less effective if used on their own. It is thus preferred if the lipophilic composition present on the lacquer is not only composed of fatty acids. The lipophilic composition present on the lacquer may thus comprise less than 99 wt. % fatty acids, such as less than 95 wt. % fatty acids. However, lipophilic compositions essentially only comprising triglycerides, such as coconut oil, provide very low friction and do thus represent a preferred lipophilic composition present on the lacquer.

According to an embodiment, the lipophilic composition coating present on the lacquer comprises at least 1 wt. % such as at least 5 wt. %, 10 wt. %, 25 wt. %, 50 wt. %, 60 wt. %, 70 wt. %, 75 wt. %, 80 wt. %, 85 wt. % or at least 90 wt. % of alkenes and/or alkanes, e.g. alkanes and 0.1 to 50 wt. %, such as 1 to 40 wt. % or 5 to 30 wt. % triglycerides and/or fatty acids.

According to another embodiment, the lipophilic composition coating 141*b* present on the lacquer comprises at least 1 wt. % such as at least 5 wt. %, 10 wt. %, 25 wt. %, 50 wt. %, 60 wt. %, 75 wt. %, 80 wt. % or at least 90 wt. % in total of triglycerides and/or fatty acids and 0.1 to 95 wt. %, such as 1 to 90 wt. % or 5 to 60 wt. % alkenes and/or alkanes, e.g. alkanes.

As already mentioned, typical examples of compounds comprising C8 to C40 non-aromatic hydrocarbyl groups are tri-glycerides and fatty acids. According to an embodiment, the lipophilic composition coating present on the lacquer comprises triglycerides and/or fatty acids. The lipophilic composition coating may thus comprise more than 25 wt. %, e.g. more than 50 wt. %, such as 50 to 100 wt. %, or 75 to 95 wt. %, in total of triglycerides and fatty acids. The triglycerides and/or fatty acids may either be used as the major component in the lipophilic composition coating or as additives.

If to be used as a major component, the lipohilic composition present on the lacquer coating may comprise more than 50 wt. %, such as 50 to 100 wt. %, or 75 to 95 wt. %, triglycerides, e.g. triglycerides to at least 90%. wt composed of a glycerol residue and 3 residues of caproic acid, caprylic acid, capric acid, lauric acid, myristic acid, palmitic acid, stearic acid, and/or arachidic acid, such as 3 residues of lauric acids, myristic acid, palmitic acid, and/or stearic acid. According to an embodiment, the lipophilic composition coating present on the lacquer comprises coconut oil, such as at least 25 wt. % such as at least 50 wt. %, 60 wt. %, 70 wt. %, 75 wt. %, 80 wt. %, 85 wt. % or at least 90 wt. % coconut oil. Coconut oil comprises triglycerides composed of fatty acids that are to a high degree saturated fatty acids. The coconut oil may be hydrogenated to various degrees to further reduce the amount of unsaturated fatty acids residues. Further, the lipohilic composition coating present on the lacquer may comprise more than 50 wt. %, such as 50 to 100 wt. %, or 75 to 95 wt. % fatty acids, e.g. caproic acid, caprylic acid, capric acid, lauric acid, myristic acid, palmitic acid, stearic acid, and/or arachidic acid, such as lauric acids, myristic acid, palmitic acid, and/or stearic acid. Furthermore, the lipophilic composition coating present on the lacquer may comprise more than 50 wt. %, such as 50 to 100 wt. %, or 75 to 95 wt. % alkyl esters of fatty acids, e.g. methyl or ethyl esters. The esterfied fatty acids may be caproic acid, caprylic acid, capric acid, lauric acid, myristic acid, palmitic acid, stearic acid, and/or arachidic acid, such as myristic acid, palmitic acid, and/or stearic acid.

If to be used as an additive, the lipohilic composition coating present on the lacquer may comprise 0.1 to 50 wt. %, such as 1 to 30 wt. % or 5 to 15 wt. %, triglycerides, e.g. triglycerides to at least 90% composed of a glycerol residue and 3 residues of caproic acid, caprylic acid, capric acid, lauric acid, myristic acid, palmitic acid, stearic acid, and/or arachidic acid, such as 3 residues of lauric acids, myristic acid, palmitic acid, and/or stearic acid. A preferred example of composition to be used to provide a lipohilic composition coating comprising triglycerides is coconut oil. According to an embodiment, the lipohilic composition coating present on the lacquer comprises coconut oil, such as 0.1 to 50 wt. %, such as 1 to 30 wt. % or 5 to 15 wt. %, coconut oil. According to an embodiment, the lipophilic composition coating 141*b* present on the lacquer comprises at least 50 wt. % coconut oil, such as at least 60 wt. %, 70 wt. %, 75 wt. %, 80 wt. %, 85 wt. %, or at least 90 wt. % coconut oil. Coconut oil comprises triglycerides composed of fatty acids that are to a high degree saturated fatty acids. The coconut oil may be hydrogenated to various degrees to further reduce the amount of unsaturated fatty acids residues. Further, the lipohilic composition present on the lacquer may comprise 0.1 to 50 wt. %, such as 1 to 30 wt. % or 5 to 15 wt. %, of fatty acids, e.g. caproic acid, caprylic acid, capric acid, lauric acid, myristic acid, palmitic acid, stearic acid, and/or arachidic acid, such as lauric acid, myristic acid, palmitic acid, and/or stearic acid. Furthermore, the lipohilic composition coating present on the lacquer may comprise 0.1 to 50 wt. %, such as 1 to 30 wt. % or 5 to 15 wt. %, of alkyl esters of fatty acids, e.g. methyl or ethyl esters. The esterfied fatty acids may be caproic acid, caprylic acid, capric acid, lauric acid, myristic acid, palmitic acid, stearic acid, and/or arachidic acid, such as myristic acid, palmitic acid, and/or stearic acid.

Both saturated and un-saturated compounds comprising C6 to C40 non-aromatic hydrocarbyl groups are well-known in the art. While both types of compounds will be efficient in reducing the sliding resistance, saturated compounds comprising C6 to C40 non-aromatic hydrocarbyl groups are deemed to be less sensitive to oxidative degradation. Thus, it may be preferred to use compounds comprising C6 to C40 non-aromatic hydrocarbyl groups being triglycerides composed of saturated fatty acids residues and/or saturated fatty acids in the composition. It may however not be necessary to use a 100% saturated fatty acids and/or triglycerides. As example, coconut oil is envisaged to have sufficient long term stability, though saturated fatty acids and/or triglycerides are preferred in terms of their long term stability.

As mentioned, the lipophilic composition coating present on the lacquer may comprises at least 1 wt. % C6 to C40 alkanes. As an example, the lipophilic composition coating present on the lacquer may thus comprise mineral oil, such as at least 1 wt. %, such as at least 5 wt. %, 10 wt. %, 25 wt. %, 50 wt. %, 60 wt. %, 70 wt. %, 75 wt. %, 80 wt. %, 85 wt. % or at least 90 wt. % mineral oil. Mineral oil is a colorless, odorless, light mixture of higher alkanes from a non-vegetable (mineral) source. Further, the lipophilic composition present on the lacquer coating may comprise liquid paraffin, such as at least 1 wt. %, such as at least 5 wt. %, 10 wt. %, 25 wt. %, 50 wt. %, 60 wt. %, 70 wt. %, 75 wt. %, 80 wt. %, 85 wt. % or at least 90 wt. % liquid paraffin. Liquid paraffin, also known as paraffinum liquidum, is a very highly refined mineral oil used in cosmetics and for medical purposes. A preferred form is the one having CAS number 8012-95-1. Furthermore, the lipophilic composition coating present on the lacquer may comprise petroleum jelly (also known as petrolatum, white petrolatum, soft paraffin or multi-hydrocarbon), such as at least 1 wt. %, such as at least 5 wt. %, 10 wt. %, 25 wt. %, 50 wt. %, 60 wt. %, 70 wt. %, 75 wt. %, 80 wt. %, 85 wt. % or at least 90 wt. % petroleum jelly. Petroleum jelly is a semi-solid mixture of hydrocarbons (with carbon numbers mainly higher than 25). A preferred form is the one having CAS number 8009-03-8.

Figure 3A:
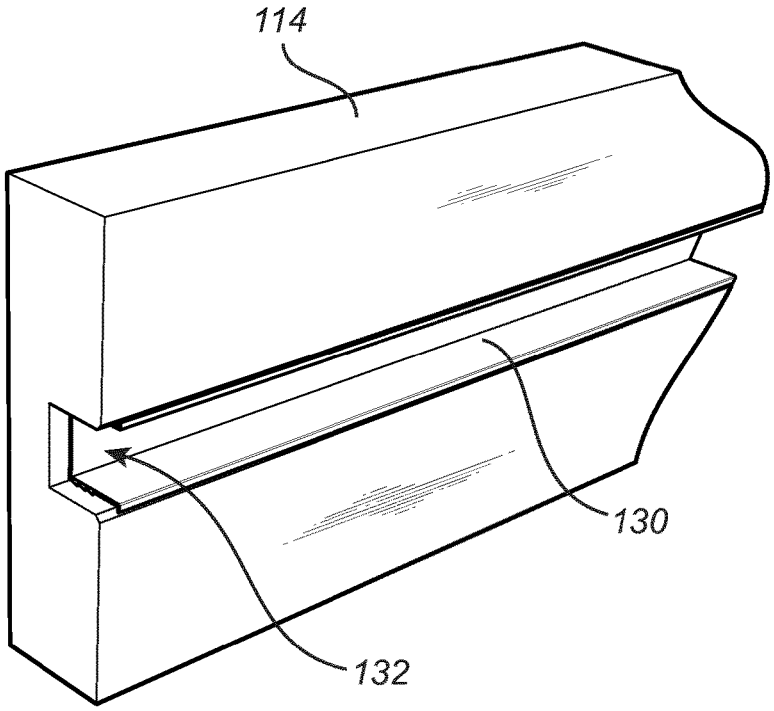
FIG. 3*a* is an isometric view of a part of a sliding system according to an embodiment.
Figure 3B:
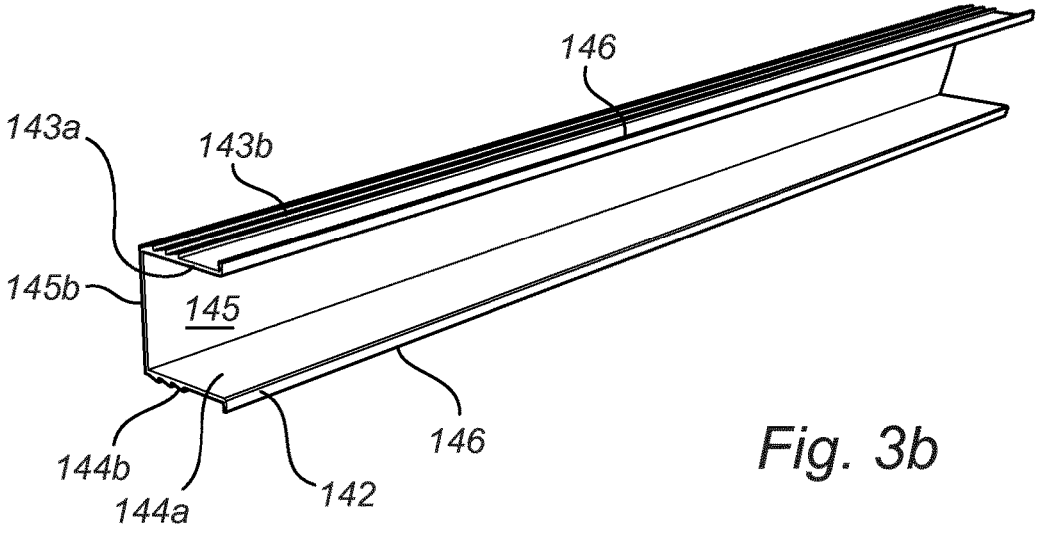
FIG. 3*b* is an isometric view of an insert for the sliding system shown in FIG. 3*a;*

The groove 130, being shown in more details in FIG. 3*a*, is in this embodiment C-shaped and is provided with a low friction sliding surface 140 in accordance with the description above. In a preferred embodiment this low friction surface 140 is formed onto an insert 142 having a C-shape dimensioned to fit within a pre-made recess 132 in the respective parallel member 112, 114. The insert 142 is shown in FIG. 3*b*. Preferably the insert 142 extends along the entire length of the recess 132, or close to the entire length of the recess 132. The insert 142, preferably being made of metal, thus has an upper inner surface 143*a*, a lower inner surface 144*a*, and a distal inner surface 145*a*. The upper and lower inner surfaces 143*a*, 144*a* are preferably extending in parallel with each other whereby the distal inner surface 145*a* extends perpendicularly to the upper and lower surfaces 143*a*, 144*a*. The upper and lower surfaces 143*a*, 144*a* thus extend in the horizontal plane, while the distal surface 145*a* extends in the vertical plane. All surfaces 143*a*, 144*a*, 145*a* are provided with superior low friction properties according to the principles described above, and these together form, in this embodiment, the low friction surface 140 of the sliding system 200.

The insert 142 is attached to the recess 132 e.g. by an adhesive, by friction or similar. For this purpose the outer surfaces of the insert 142, i.e. the upper outer surface 143*b*, the lower outer surface 144*b*, and the distal outer surface 145*b* may be provided with a rough surface in order to increase the contact area for the adhesive, and/or to provide for friction based attachment. These surfaces 143*b*, 144*b*, 145*b* thus form a fastening arrangement adapted for connecting the insert 142 to the respective parallel member 112, 114. The proximal end of the upper and lower surfaces 143*a-b*, 144*a-b* may also be provided with a respective flange 146 in order to secure the position of the insert 142 relative the planar surface of the respective parallel member 112, 114.

The sliding surface 140 is configured to receive at least one sliding member 150 provided on the surface of the adjacent parallel member 122, 124 of the moveable part 120 of the extendable table sliding system 10. The low friction surface 140 of the insert 142 is thus allowed to engage with the sliding member 150 such that the moveable part 120 of the extendable table sliding system 10 can be pulled in and out relative the fixed part 110 of the extendable table sliding system 10, or vice versa.

Figure 4A:
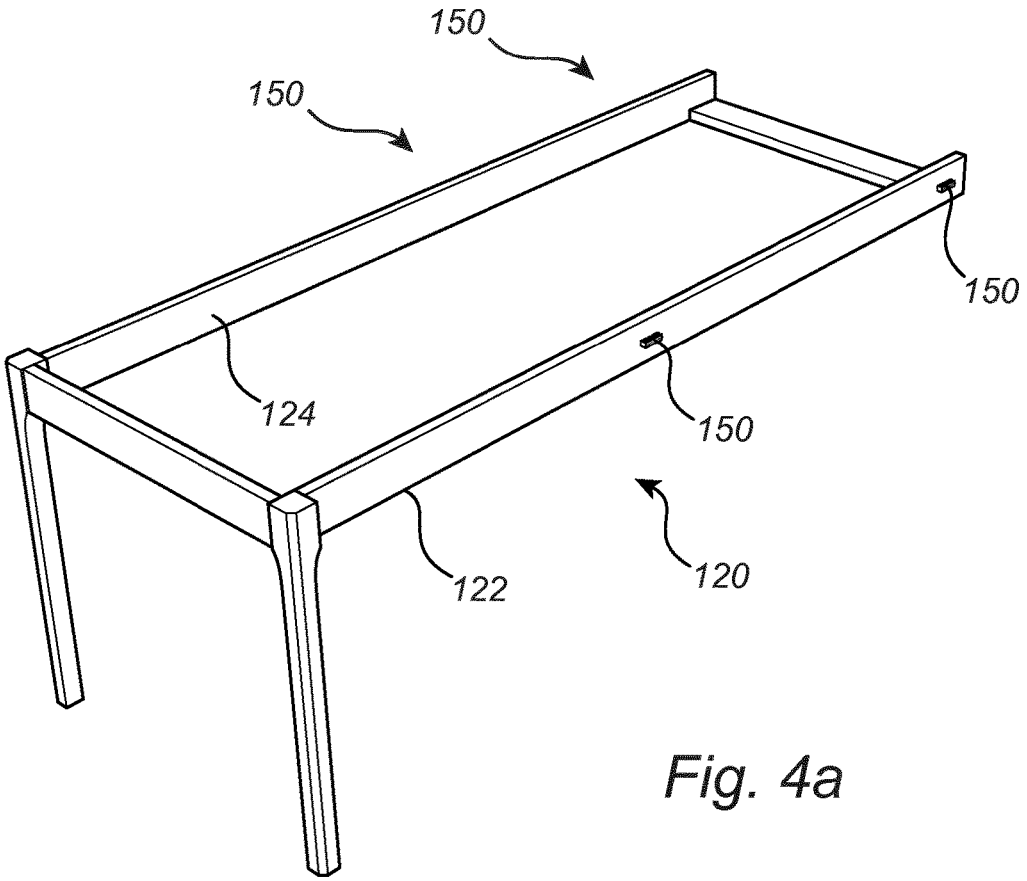
FIG. 4*a* is an isometric view of a moveable part of an extendable table sliding system according to an embodiment.

The moveable part 120 of the extendable table sliding system 10 is shown in FIG. 4*a*, in which the fixed part of the extendable table sliding system 10 has been omitted for clarification purposes. In this embodiment the parallel members 122, 124 of the moveable part 120 are provided with two sliding members 150 each. For each parallel member 122, 124 the sliding members 150 are arranged at a certain longitudinal distance from each other. For this embodiment the longitudinal distance between the two sliding members 150 of one member 122, 124 is selected such that both of the two sliding members 150 will always remain received by the insert 142, also when the moveable part 120 of the extendable table sliding system 10 is pulled out from the fixed part 110 of the extendable table sliding system 10 to its most extended position.

When two or more sliding members 150 are used for the same parallel member 122, 124 it is realized that the length of each sliding member 150 may be significantly reduced compared to if only one sliding member 150 would be used. This is due to the fact that the sliding member(s) 150 must secure the horizontal position of the moveable part 120 of the extendable table sliding system 10 as there are legs 6*a-b* only at one end of the moveable part 120. The required longitudinal extension of each sliding member 150 can thus be said to decrease as the number of sliding members 150 is increased.

Figure 4B:
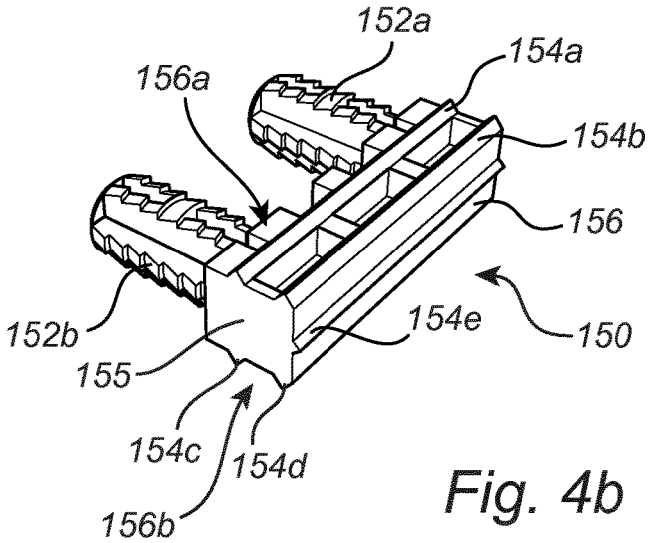
FIG. 4*b* is an isometric view of a sliding member for use with a sliding system according to an embodiment.

The sliding member(s) 150 can be attached to the respective parallel member 122, 124 in a number of ways. In FIG. 4*b* one example of a sliding member 150 is shown having fastening devices in the form of two dowels 152*a*, 152*b* to be pushed into mating recesses, such as holes, in the associated parallel member 122, 124. Other suitable fastening devices of the sliding member 150 could e.g. include adhesives, screws, threaded screw holes, etc. However for furniture manufacturing the use of dowels 152*a*, 152*b* has proven to be particularly advantageous due to its robustness in combination with the extremely fast and simple attachment procedure.

As has already been explained above the sliding system 200 comprises the disclosed sliding surface 140 and at least one sliding member 150. The sliding surface 140 is typically linear, such as formed by a linear aluminum or steel profile. By arranging the interface between the sliding surface 140 and the sliding member 150 in sliding contact a linear plain bearing is provided. The sliding member 150 is arranged to allow for linear movement of the sliding member 150 in sliding over the sliding surface 140 along the longitudinal axis. Further, the sliding surface 140 may be provided in the shape of a groove 130 extending along a longitudinal axis and defining a slide direction. When the sliding surface 140 is provided by means of a groove 130, the slide layer is present inside the groove 130.

The groove 130, forming a track, improves the control of the lateral position of the sliding member 150 in relation to the sliding surface 140 when the sliding member 150 slides along the sliding surface 140.

Further, the part of the sliding member 150 arranged in contact with the sliding surface 140 may be configured as a blade extending in the sliding direction. It was surprisingly found that decreasing the contact area at the interface between the sliding surface 140 and the sliding member 150 reduced the friction. Normally the risk for the bearing seizing typically increases with reduced contact area. In order to provide the sliding system, the sliding member 150 comprises at least one contact point in contact with the sliding surface 140 at the interface between the sliding surface 140 and the sliding member 150. According to an embodiment, the contact area of each individual contact point is less than 3 $mm^2$, such as less than 1.5 $mm^2$, or less than 0.75 $mm^2$. The slide member 150 may further be provided with more than one contact point, such as 2, 3, or 4 contact points. If the sliding member 150 is provided with one or more blade(s) extending in the sliding direction, the edge of the respective blade(s) represents the contact point.

It has been found that the friction becomes lower when the contact pressure between the sliding member 150 and the sliding surface 140 is relatively high. The contact pressure is calculated by dividing the load carried by each individual contact point by the contact area of the contact point. In an example, in which a sliding system of a somewhat similar type was tested for sliding doors the contact pressure was calculated. The sliding door had a total weight of 8.5 kg meaning a total load of 83.3 N. The sliding door was carried by two sliding members where each sliding member had four contact points, each such contact point having an area of 0.675 $mm^2$. The contact pressure was then: $83.3\ N/(2\times 4\times 0.675\ mm^2)=15.4\ N/mm^2$. Similar calculations may be performed for the present extendable table sliding system and similar high loads are suitable. Hence, preferably, the contact pressure in said at least one contact point is at least 4 $N/mm^2$, more preferably at least 8 $N/mm^2$, such as at least 12 $N/mm^2$. Preferably, the contact pressure is lower than the strain at yield (=yield strength) for the material from which the sliding member is made.

In order to provide low friction, at least the part of the sliding member 150 in contact with the sliding surface 140 is preferably made of a plastic comprising a polymer, such as a polymer comprising polar groups. Examples of such polar groups include hydroxyl groups, carboxylic acid groups, amide groups, halide groups, sulfide groups, cyano groups (nitrile groups), carbamate groups, aldehyde groups, and/or ketone groups The polymer may preferably be selected from the group consisting of polyoxymethylenes (POM), polyesters (e.g. thermoplastic polyesters, such as polytrimethylene terephthalate (PTT), polybutylene terephthalate (PBT), and polylactic acid (PLA), as well as bio-based thermoplastic polyesters, such as polyhydroxyalkanoates (PHA), polyhydroxybutyrate (PHB), and polyethylene furanoate (PEF)), polyethylene terephthalate (PET), polyamides (PA), polyvinyl chloride (PVC), polyphenylene sulfide (PPS), polyaryletherketone (PAEK; e.g. Polyether ether ketone (PEEK)), and Polytetrafluoroethylene (PTFE). These polymers are particularly good at combining mechanical strength with a low friction in the present arrangements. Further, not only the part of the sliding member 150 in contact with the sliding surface 140 may be made of a polymer, but the entire sliding member 150. Thus, sliding member may be made from a plastic comprising a polymer. As recognized by the skilled person, the plastic may further comprise other additives, such as fillers, colorants, and/or plasticizers. Further, the sliding member 20 may be made from a composite comprising a polymer, such as one of the above listed polymers, optionally filled with particles and/or fibers. The particles and/or fibers will increase the hardness, the stiffness, the creep resistance and elongation (compression) at yield of the sliding member 20. While not affecting the friction, presence of particles and/or fibers may however affect the wear. Thus, use of particles and/or fibers in the plastic is less preferred.

According to an embodiment the sliding member 150 may be provided with two parallel, displaced blades in order to reduce the risk for rotation along the sliding axis. Further, the sliding surface 140 may be provided with two parallel depressions arranged along each side of its longitudinal sliding axis (see FIG. 4*c*). Parallel depressions may support and guide such two parallel blades of the sliding member 150. Furthermore, the sliding member 150 may be provided with two or more parallel blades arranged along the same longitudinal axis. The sliding member 150 may be provided with two parallel blades adapted for running in the same depression independently of the presence, or non-presence, of parallel, displaced blades adapted for running in two parallel depressions.

Still having FIG. 4*b* in mind and again returning to the description regarding the general principle of the sliding system 200, the sliding member 150 is preferably made of plastic. Each sliding member 150 has a number of relatively sharp protrusions 154*a-e*, e.g. having the form of blades in accordance with the description above, extending out from a main body 155. When mounted the dowels 152*a-b* are received within the parallel member 122, 124 so that only the main body 155 with its protrusions, i.e. blades, 154*a-e* protrude into the respective insert 142 of the adjacent parallel member 112, 114 of the fixed part 110 of the extendable table sliding system 10.

The sliding member 150 being shown in FIG. 4*b* has five protrusions 154*a-e*. The upper surface 156*a* of the main body 155 is provided with two parallel protrusions 154*a-b*, the lower surface 156*b* of the main body 155 is provided with two parallel protrusions 154*c-d*, and the distal surface 156*c* of the main body 155 is provided with one protrusion 154*e*. Each protrusion 154*a-e* may extend along the entire length of the main body 155, as illustrated in FIG. 4*b*, but it is also possible to divide each protrusion into several shorter segments. The upper and lower protrusions 154*a-d* ensure the correct vertical position of the sliding member(s) 150 within the insert 142, while the distal protrusion 154*e* provides alignment in the horizontal plane relative the insert 142.

Hence, the sliding member 150 is provided with at least one blade 154*a-b*, the tip of which extends in a first, i.e. upwards, direction from a first surface 156*a*, and at least one blade 154*c-d*, the tip of which extends in a second, i.e. downwards, direction from a second surface 156*b*. As is evident from FIG. 4*b* the first and second surfaces 156*a-b* are parallel, and the first upward direction is opposite to the second downward direction.

The sliding member 150 is also provided with at least one blade 154*e* extending in a third, i.e. outwards, direction from a third surface 156*c*. The first and third surfaces 156*a*, 156*c* are obviously non-parallel, as the third surface 156*c* extends between the first and second surfaces 156*a-b*. The first and second directions are thus perpendicular to the third outwards direction.

Each protrusion 154*a-e* preferably has a pyramidal shape, i.e. the distal end of each protrusion 154*a-e* forms an apex. Hence each protrusion 154*a-e* will only form a very small contact area with the insert 142. It should be understood that the exact number of sliding members 150 for each parallel member 122, 124 and the exact configuration of the protrusions 154*a-e* is to be determined based on specific application parameters, such as length of the table 1, the desired force being required to pull and push the moveable part 120 of the extendable table sliding system 10, the material of the sliding member 150, the mechanical strength of the sliding surface 140, etc.

Figure 4C:
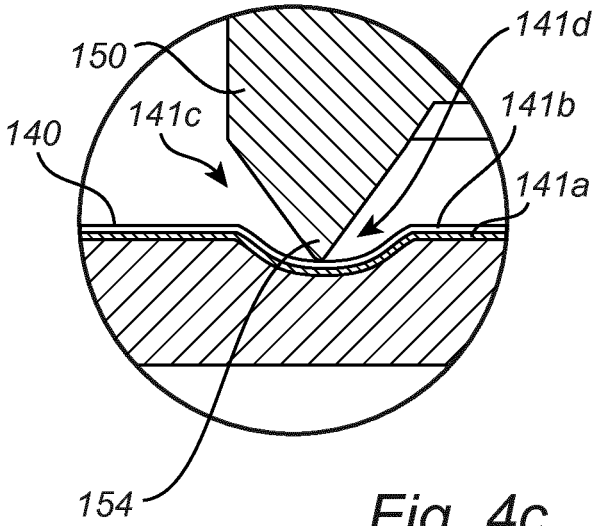
FIG. 4*c* is a cross-sectional view of the contact between a sliding member and a sliding surface according to an embodiment.

FIG. 4*c*, being an enlarged principle view of the contact between a protrusion, e.g. a blade, 154 and the sliding surface 140, illustrates how the sliding surface 140 is coated with the lacquer comprising a resin 141*a*. The lacquer comprising a resin 141*a* is in turn coated with a lipophilic composition coating 141*b*. Thereby a slide layer 141*c* is formed. The sliding member 150 may slide over this slide layer 141*c* at a very low friction. As can be seen in FIG. 4*c* the sliding surface 140 is provided with a concave depression 141*d* for receiving the protrusion 154 of the sliding member 150, in accordance with the description above. Also, FIG. 4*c* clearly shows the relatively sharp tip of the protrusion 154.

Figure 5:
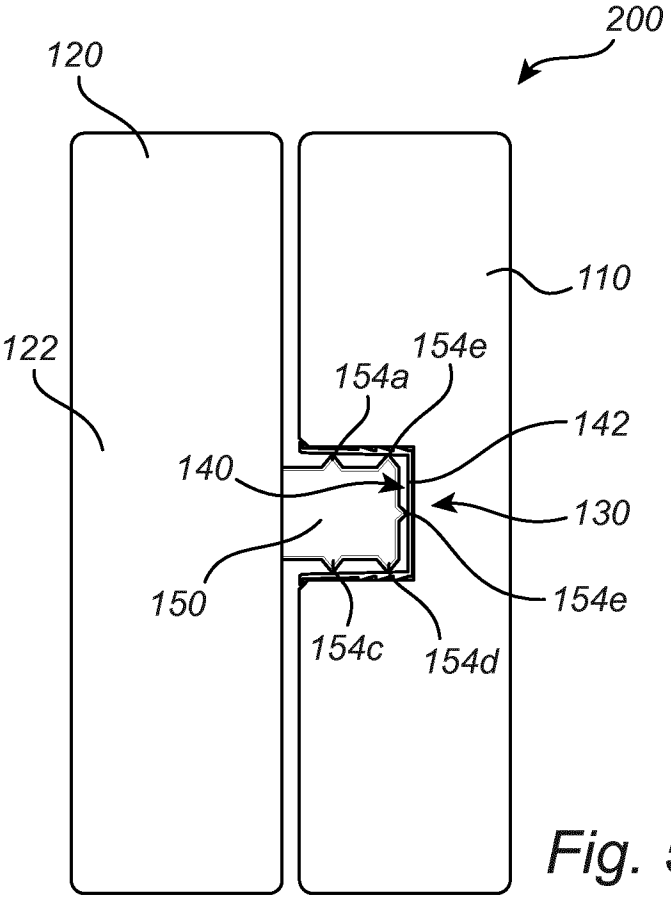
FIG. 5 is a cross-sectional view of a sliding system for use with an extendable table according to an embodiment.

A cross-section of the sliding system 200 is shown in FIG. 5. The connection between a parallel member 112 of the fixed part 110 of the extendable table sliding system 10 and an adjacent parallel member 122 of the moveable part 120 of the extendable table sliding system 10 is clearly shown to be realized by a sliding member 150 being received by the groove 130 and its associated sliding surface 140 such that the protrusions 154*a-e* of the sliding member 150 slides against the low friction sliding surface 140 of the insert 142. A relative movement between the parallel members 112, 122 is thus possible. Although not specifically shown in FIG. 5, the sliding surface 140 is provided with a low friction slide layer in accordance with FIG. 4*c* and the description above.

Figure 6:
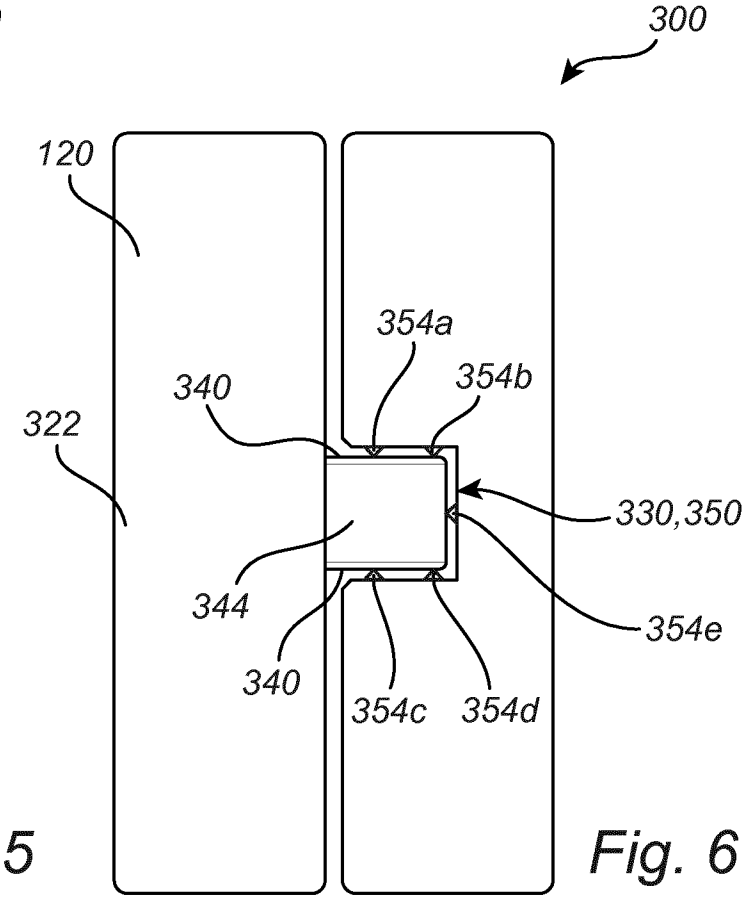
FIG. 6 is a cross-sectional view of a sliding system for use with an extendable table according to another embodiment.

A yet further alternative for a sliding system 300 is shown in FIG. 6. This embodiment is similar to the embodiment described with respect to FIG. 5, however the sliding member and the sliding surface have changed their respective position. In this embodiment a sliding member 350 is formed by a groove 330 extending along the parallel member of the first part 110, which groove 330 is in this embodiment C-shaped and is provided with a plurality of protrusions, e.g. blades, 354*a-e* extending horizontally along the first part 110, the protrusions 354*a-e* having tips that protrude inwardly, i.e. towards the sliding surface 340, so that they can engage with planar surfaces of the sliding surface 340. For this embodiment it is possible to manufacture the parallel member 112, including the groove 330, as one plastic piece, whereby all of the protrusions 354*a-e* are also made of plastic and are in contact with the sliding surface 340. According to an alternative embodiment the groove 330 could be provided with a plastic insert carrying the protrusions. Such plastic insert could have a similar design as the insert 142 illustrated in FIG. 3*b*, but being provided with the protrusions 354*a-e*. Returning to FIG. 6 the sliding surface 340 is for this embodiment provided on a sliding surface carrying protruding member 344 having planar surfaces being treated to provide low friction in accordance with the general description of the sliding system above, see for example the description connected to FIG. 4*c*. Hence, the protruding member 344 may for example be made of aluminum or steel and coated with a lacquer comprising a resin, for example applied using the Honny process, and then provided with the lipophilic composition to form the slide layer. The protruding member 344 having the sliding surfaces 340 is thus dimensioned to fit in the groove 330 of the sliding member 350, analogous to the embodiments described previously. The protruding member 344 thus has an upper sliding surface, a lower sliding surface, and a distal sliding surface. The length of the protruding member 344, i.e. the longitudinal extension of the protruding member 344 as seen along the sliding direction of the sliding member 350, is substantially shorter than the length of the sliding member 350, i.e. the groove 330. For robustness of the sliding system 300, two or more protruding members 344 may be arranged on the parallel member 322, in a manner similar to the arrangement of the sliding members 150 on the member 122 as illustrated in FIG. 4*a*, the protruding members 344 being spaced apart along the sliding direction.

Figure 7A:
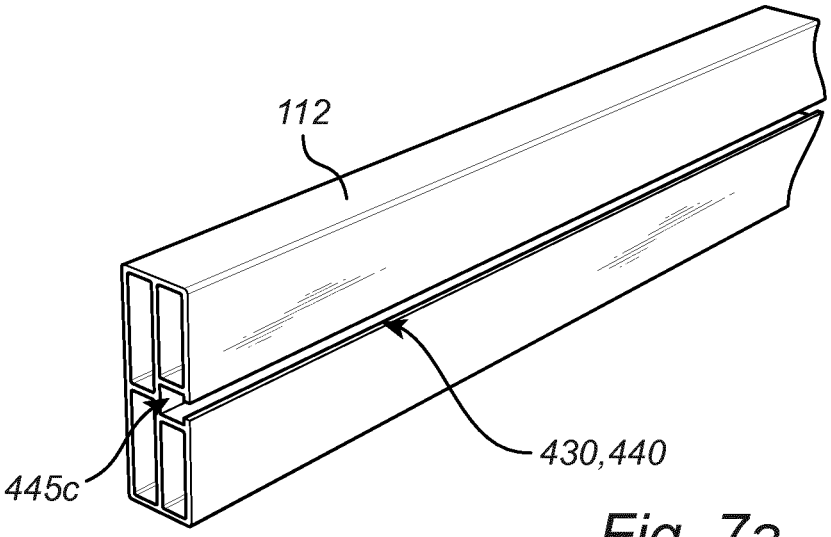
FIG. 7*a* is an isometric view of a sliding system for use with an extendable table according to a yet further embodiment.

In FIG. 7*a* cross-sectional view of a part of a sliding system 400 according to another embodiment is shown. For this embodiment the sliding member 450 and its associated parallel member 122 are of a similar design to what has been described above with respect to FIGS. 3*a*, 4*a-b*, and 5. However the sliding surface 440 is in this embodiment formed integral with the parallel member 112. The parallel member 112 is in this embodiment a metal profile, e.g. being made of aluminum or steel, wherein a C-shaped recess or groove 445*c* is integrally formed by the surfaces of the profile. These surfaces of the C-shaped groove 445*c* are treated, according to the principles described hereinbefore, for example with reference to FIG. 4*c*, to provide the low friction surface 440 onto which the sliding member(s) 450 are guided.

Figure 7B:
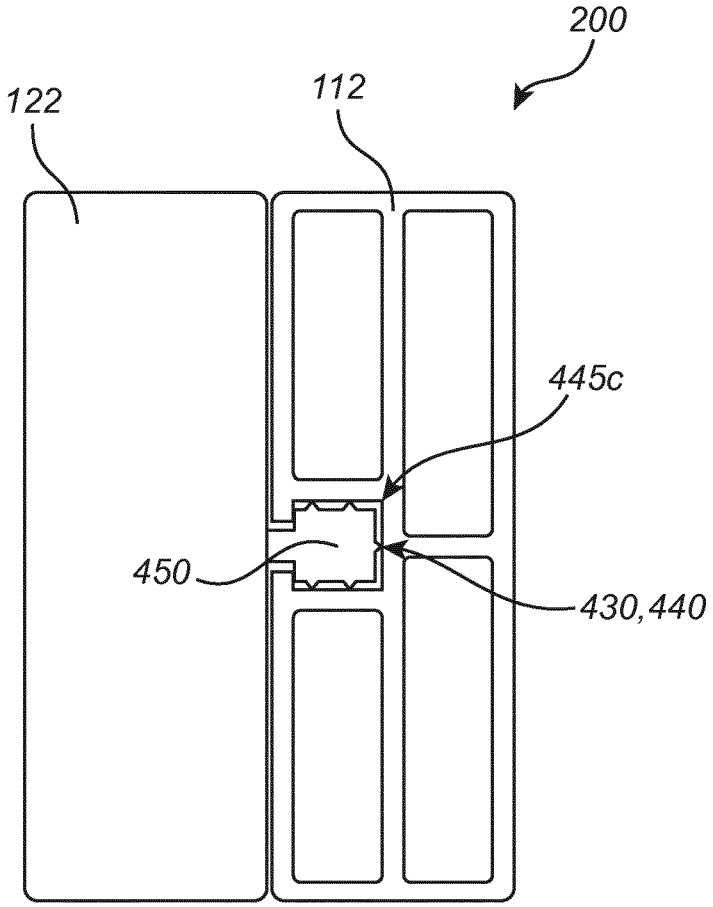
FIG. 7*b* is a cross-sectional view of the sliding system shown in FIG. 7*a;*

In FIG. 7*b* the sliding system 400 is shown, utilizing the sliding surface 440 of FIG. 7*a* and a sliding member 450 engaging with the low friction surface 440. As already mentioned, the sliding member 450 is similar to the sliding member 150 shown in FIGS. 3*a*, 4*a-b*, and 5.

Figure 8A:
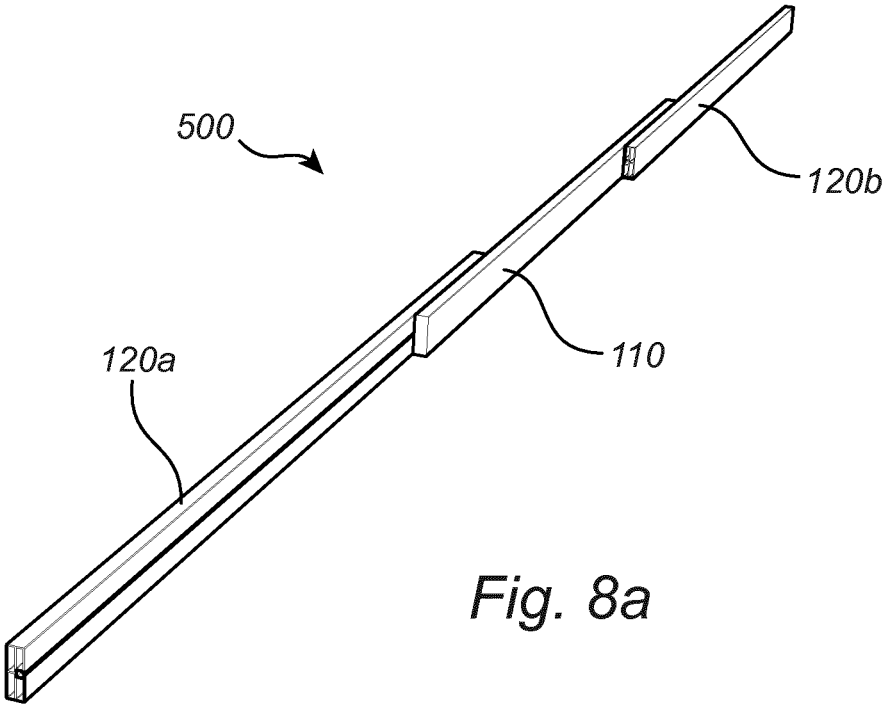
FIG. 8*a* is an isometric view of a sliding system according to an embodiment.
Figure 8B:
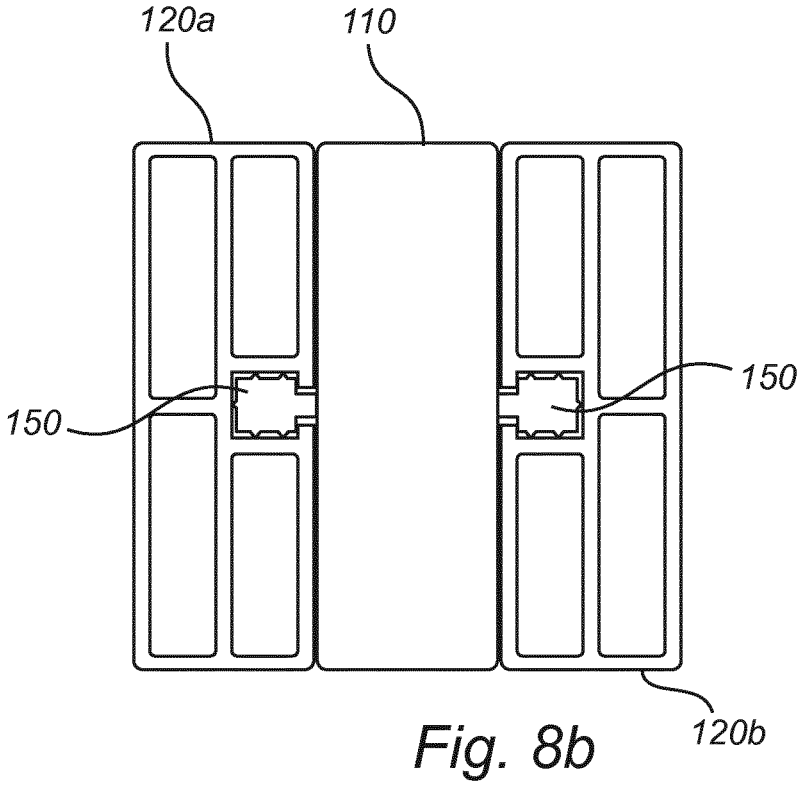
FIG. 8*b* is a cross-sectional view of the sliding system shown in FIG. 8*a*.

In FIGS. 8*a-b* another embodiment of a sliding system 500 is shown. Instead of having only one moveable part 120 of the extendable table sliding system 10 the sliding system 500 of this embodiment utilizes one fixed part 110 and two moveable parts 120*a*, 120*b* of the extendable table sliding system. The fixed part 110 will form a sliding interface with each one of the moveable parts 120*a*, 120*b*. These sliding interfaces could be formed by using any of the alternatives for the sliding member 150, 350, 450 and the low friction surface 140, 340, 440 mentioned above. In FIG. 8*b* the sliding members 150 are similar to the sliding member 150 described with reference to FIGS. 3*a*, 4*a-b*, and 5, and such sliding members 150 are, in this embodiment, attached to opposite sides of the fixed part 110, as best illustrated in FIG. 8*b*.

The sliding system 500 of this embodiment could be used in various ways for forming an extendable table sliding system 10 for an extendable table 1. A fixed table surface could e.g. be securely attached to the fixed intermediate parallel part (indicated by reference numeral 110 in FIGS. 8*a-b*), while additional extension table surfaces could be arranged on top of the moveable parts 120*a-b* when these are pulled out, in opposite directions, from the fixed part 110. The additional table surfaces will thus be positioned on a respective side of the fixed table surface. This makes it possible to obtain a higher degree of extension compared to the table illustrated in FIGS. 1*a-c*.

In another example a fixed table surface could e.g. be securely attached to one of the thus fixed end parts (indicated by reference numeral 120*a* in FIGS. 8*a-b*), while one or more additional extension table surfaces could be arranged on top of the adjacent (and thus moveable) parts 110, 120*b* when these are pulled out from the fixed part 120*a*. The additional extension table surface(s) will thus be positioned on only one side of the fixed table surface.

A yet further alternative embodiment could be realized by securely attaching one fixed table surface to the end part 120*a*, and another fixed table surface to the other end part 120*b*. These end parts 120*a, b* form movable parts 120*a*, 120*b* of the extendable table sliding system 10 as they can be pulled away from each other leaving a gap between them, above the intermediate and fixed part 110. An additional extension table surface could thus be positioned in this gap, i.e. on top of the fixed part 110, for extending the overall table surface of the table 1.

The embodiment of FIGS. 8*a-b* comprises totally three parts 110, 120*a*, 120*b* linked to each other. It will be realized that still further parts could be linked to each other in an extendable table sliding system, in case an even longer extension possibility is desired for a table.

As can be seen in FIG. 8*b* the two moveable parts 120*a*, 120*b* are identical to the parallel member 112 shown in FIG. 7*a*. However, as is readily understood one or more of the two moveable parts 120*a*, 120*b* could be realized as the fixed part 110 shown in FIG. 5.

Figure 9:
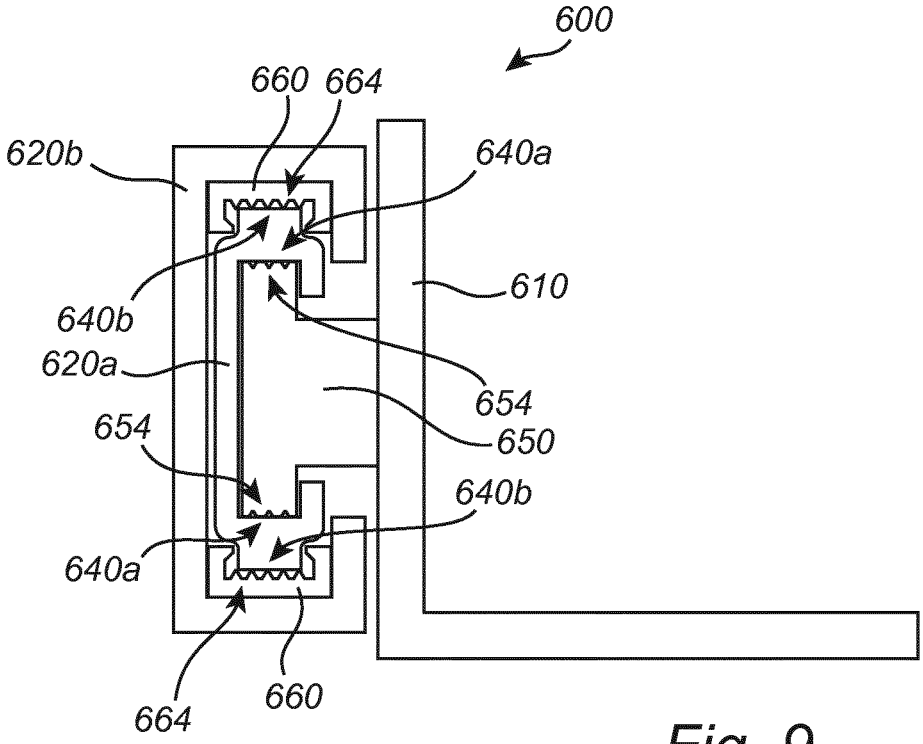
FIG. 9 is a cross-sectional view of a sliding system for use with an extendable table according to another embodiment.

In FIG. 9 another embodiment of a sliding system 600 is shown in cross-section. This embodiment shares the same concept as the previous embodiment, i.e. that one fixed part 610 is in sliding connection with two moveable parts 620*a*, 620*b*. Hence two sliding interfaces are provided, the first one being realized by the sliding engagement between the fixed part 610 and one intermediate moving part 620*a*. The second sliding interface is realized by the sliding engagement between the intermediate moving part 620*a*, and the outer moving part 620*b*.

The first sliding interface is accomplished by providing the fixed part 610 with at least one sliding member 650. The sliding member 650 may, for example, be made from a polymer as described hereinbefore with reference to the sliding member 150 and extends laterally from the fixed part 610 and it is provided with upper and lower protrusions, e.g. blades 654. The exact number of blades 654 at the upper and lower end of the sliding member 650 could be varied depending on the particular application.

The intermediate movable part 620*a* is preferably a metallic member having inwardly directed sliding surfaces 640*a* and associated low friction slide layers facing the blades 654 of the sliding member 650 of the fixed part 610. The intermediate moveable part 620*a* is preferably C-shaped thereby forming a C-shaped groove such that the intermediate movable part 620*a* may surround the upper and lower blades 654 of the sliding member 650, while lateral movement of the intermediate moveable part 620*a* relative the sliding member 650 is prevented.

The intermediate moveable part 620*a* is also provided with upper and lower sliding surfaces 640*b* facing outwards. These outwardly directed sliding surfaces 640*b* are configured to engage with a sliding member 660 of the outer moveable part 620*b*.

The outer moveable part 620*b* is preferably also C-shaped such that it surrounds the intermediate moveable part 620*a*. Inside the outer moveable part 620*b* an upper sliding member 660 is provided to be arranged in contact with the upper outwardly directed sliding surface 640*b* of the intermediate moveable part 620*b*. Also, inside the outer moveable part 620*b* a lower sliding member 660 is provided to be arranged in contact with the lower outwardly directed sliding surface 640*b* of the intermediate moveable part 620*a*. The sliding members 660 may, for example, be made from a polymer as described hereinbefore and may not necessarily extend along the entire length of the outer moveable part 620*b*, but may be positioned at specific positions along the length of the outer moveable part 620*b*. The sliding surfaces 640*a*, 640*b* of the intermediate moveable part 620*a* may have a design similar to that of the sliding surface 140 described hereinbefore with reference to FIG. 4*c*.

The sliding members 660 are provided with respective protrusions, e.g., blades 664 so that a sliding engagement is provided in line with the description above of the previous embodiments. Hence, the intermediate moveable part 620*a* may slide relative the fixed part 610, and the outer moveable part 620*b* may slide relative the intermediate moveable part 620*a* so that a comparably long extension may be obtained. For example, a fixed table surface could be fixed to the fixed part 610, and one or more extension table surfaces could be releasably positioned on top of the movable part 620*b*.

Furthermore there is, according to an embodiment, provided a method for providing a sliding surface 140 for a sliding system 200, 300, 400, 500, 600. In such a method there is provided a sliding surface 140, 340, 440, 640 having a slide surface coated with a lacquer comprising a resin. In order to provide the sliding surface 140, 340, 440, 640 with lowered friction, the lacquer is, at least partly, coated with a lipophilic composition coating. Aspects of the sliding surface 140, 340, 440, 640, the lacquer, and the lipophilic composition coating have been provided herein above and are applicable to this embodiment as well. In applying the lipophilic composition to provide the lipophilic composition coating, the lipophilic composition may firstly be heated, such as melted, to reduce its viscosity. Further, the lipophilic composition may be dissolved in a solvent to facilitate application. After application, any such solvent may be evaporated, at least partly. Lipophilic composition being in a liquid state at room temperature may also be applied directly. The lipophilic composition to provide the lipophilic composition coating may applied in various ways, such as by spraying, smearing, painting, coating, spreading etc.

According to an embodiment, the lipophilic composition is applied by the end-consumer. Thus, the sliding surface 140, 340, 440, 640, the sliding system 200, 300, 400, 500, 600 or arrangements comprising the sliding surface 140, 340, 440, 640 may be provided together with a lipophilic composition to be applied by the end-consumer, i.e. the lacquer is un-coated upon delivery.

Similarly, another embodiment relates to the use of such a lipophilic composition as an irreversibly bound lubricant for a sliding surface 140, 340, 440, 640. By "irreversibly bound lubricant" is, according to an embodiment, meant that the lubricant is not removed from the slide surface 140, 340, 440, 640 during normal operation of the sliding system 200, 300, 400, 500, 600 and that it cannot be easily removed using mechanical means, e.g. it cannot be removed by wiping the slide surface with a cloth. As described herein, the sliding surface 140, 340, 440, 640 is coated with a lacquer comprising a resin. Aspects of the sliding surface 140, 340, 440, 640, the lacquer, and the lipophilic composition coating have been provided herein above and are applicable to this embodiment as well.

Without further elaboration, it is believed that one skilled in the art may, using the preceding description, utilize the present invention to its fullest extent. The preceding preferred specific embodiments are, therefore, to be construed as merely illustrative and not limitative of the disclosure in any way whatsoever.

EXAMPLES

The following examples are mere examples and should by no means be interpreted to limit the scope of the invention, as the invention is limited only by the accompanying claims.

General

All chemicals were obtained from Sigma-Aldrich. In providing mixtures, e.g. palmitic acid 10 mass % in liquid paraffin, the two compounds (e.g. 3 g palmitic acid and 27 g liquid paraffin) were mixed under heating to melt the mixture. Further, the mixtures were applied to the sliding surface 140, 340, 440, 640 before solidifying.

The test procedure used was based on SS-EN 14882:205. In short, a sled with parallel plastic blades (four in total; two along each longitudinal slide axis) of POM was positioned on an anodized aluminum profile having been anaphoretically coated with an acrylic resin and subsequently heat cured to provide a lacquered slide surface. Aluminum profiles lacquered in this way are for example provided by Sapa Profiler AB, 574 38 Vetlanda, Sweden, and are marketed under the trade name SAPA HM-white, the materials being produced using the Sapa HM-white method which is based on the above referenced Honny method. In the friction measurements, the sled was pulled over the slide bar at a constant speed of 500 mm/min and the force necessary to pull the sled was registered using an Instron 5966 tension testing system. The total weight of the sled corresponds to 10 N. Fresh profiles were used for each lipophilic composition, as the lipophilic compositions cannot be removed once applied. However, the profiles were re-used after the control experiments (no lipophilic compositions applied), washing and ageing, respectively.

Example 1

By using the test procedure described above, the resulting friction from application of various lipophilic compositions to anodized, lacquered aluminum profiles was determined. The resulting dynamic friction, mean value from three test sequences, was registered and compared to the dynamic friction for anodized aluminum profiles provided with a lacquer but not coated with any lipophilic composition (=control). The results are provided in Table 1 and 2 below.

TABLE 1

| Fatty acids in liquid paraffin | | | |
|---|---|---|---|
| Lipophilic composition | Wash | Ageing | Dynamic friction Mean (n = 3) |
| No (control) | — | — | 0.214 |
| MA 5% | — | — | 0.049 |
| MA 10% | — | 3 days | 0.046 |
| MA 30% | — | — | 0.049 |
| MA 10% | Yes | — | 0.041 |
| PA 10% | — | 3 days | 0.047 |
| PA 10% | Yes | — | 0.042 |
| SA 10% | — | 3 days | 0.050 |
| SA 10% | Yes | — | 0.044 |
| LP | — | 3 days | 0.053 |
| LP | Yes | — | 0.050 |

MA 5%/10%/30% = Myristic acid 5/10/30 mass % in liquid paraffin
PA 10% = Palmitic acid 10 mass % in liquid paraffin
SA 10% = Stearic acid 10 mass % in liquid paraffin
LP = Liquid paraffin

TABLE 2

| Triglycerides in liquid paraffin | | | |
|---|---|---|---|
| Lipophilic composition | Wash | Ageing | Dynamic friction Mean (n = 3) |
| No (control) | — | — | 0.214 |
| TM 10% | — | — | 0.0510 |
| TM 10% | Yes | — | 0.0524 |
| TP 10% | — | 3 days | 0.0454 |
| TP 10% | — | 6 weeks | 0.0513 |
| TP 10% | Yes | — | 0.0440 |
| TS 10% | — | — | 0.0524 |
| TS 10% | Yes | — | 0.0504 |
| LP | — | — | 0.053 |
| LP | Yes | — | 0.050 |

TM 10% = Trimyristate 10 mass % in Liquid paraffin
TP 10% = Tripalmitate 10 mass % in Liquid paraffin
TS 10% = Tristearate 10 mass % in Liquid paraffin
LP = Liquid paraffin

TABLE 3

| Fatty acids in liquid paraffin | | |
|---|---|---|
| Lipophilic composition | Wash | Dynamic friction Mean (n = 3) |
| LP | — | 0.054 |
| LP | Yes | 0.042 |
| LA 10% | — | 0.058 |
| LA 10% | Yes | 0.041 |
| LA 30% | — | 0.046 |
| LA 30% | Yes | 0.039 |
| LA 50% | — | 0.048 |
| LA 50% | Yes | 0.036 |
| LA 70% | — | 0.041 |
| LA 70% | Yes | 0.036 |
| Coconut oil | — | 0.033 |
| Coconut oil | Yes | 0.037 |

LA 10/30/50/70% = Lauric acid 10/30/50/70 mass % in Liquid paraffin

As can be seen from Table 1 and 2, the resulting dynamic friction was reduced by about 75% by applying a lipophilic compositions to the anodized aluminum profiles, though the initial dynamic friction of the un-coated anodized aluminum profiles was not that high. Furthermore, whereas the dynamic friction remained low and nearly the same for the coated profiles over repeated cycles, the dynamic friction for un-coated anodized aluminum profiles was significantly increased (seizing) already after less than 20 test cycles.

It can also be seen from the above tables 1 and 2 that the tests including fatty acids or triglycerides resulted in a somewhat lower friction compared to pure Liquid paraffin, in particular when the fatty acid is myristic acid or palmitic acid, and when the triglyceride is tripalmitate. Coconut oil, being a mixture of various triglycerides, in which lauric acid is the most common fatty acid residue, provided very low friction (cf. Table 3). Further, neither ageing nor washing (wiping by a wet cloth 6 times, followed by wiping 4 times with a dry cloth) had any significant effect on the dynamic friction.

Example 2

By using the test procedure described above, the resulting friction at various loads (5, 10 and 20 N, respectively) using liquid paraffin as the lipophilic composition coating was determined. Increasing the load did not result in increased friction. On the contrary, the lowest load (5 N) displayed the highest friction (friction value 0.052 (at 5N) vs. friction values 0.045 (at 10 N)/0.046 (at 20 N)).

Example 3

In an additional experiment, a corresponding aluminum bar, but without any lacquer, was used. Use of palmitic acid 10 mass % in liquid paraffin as lubricant on the non-lacquered bar resulted in a dynamic friction of 0.1132, i.e. more than 100% higher than corresponding dynamic friction obtained with the lacquered aluminum bar (cf. Table 1; 0.042 and 0.047, respectively).

Example 4

In additional examples also steel profiles as well as other lacquers were evaluated.

Lacquers: Teknotherm 4400 (Teknos)—wet spray lacquer, Standofleet® (Standox) wet spray lacquer, Powercron® 6200HE (PPG)—cationic epoxy electrocoat, Interpon AF (AkzoNobel)—powder coating, and Alesta® (Axalta)—powder coating.

Profiles: Aluminium (Al), and steel (Fe)

TABLE 4

Coconut oil on aluminum and steel profiles

| Lacquer | Profile | Dynamic friction Mean (n = 3) | Profile | Dynamic friction Mean (n = 3) |
|---|---|---|---|---|
| Teknotherm | Al | 0.040 | Fe | 0.050 |
| Standofleet | Al | 0.045 | Fe | 0.048 |
| Interpon AF | Al | 0.024 | Fe | 0.034 |
| Powercron | Al | 0.021 | Fe | 0.041 |
| Alesta | Al | 0.025 | Fe | 0.038 |

As can be seen from Table 4, the aluminum profiles displayed lower friction than the steel profiles though also the steel profiles displayed a very low friction. Further, whereas some of the alternative lacquers displayed comparable or lower friction than the SAPA HM-white profiles (dynamic friction mean: 0.033), the wet lacquered profiles displayed slightly higher friction. Without being bond to any theory, this may be due to wet lacquered profiles inherently having somewhat thicker lacquer and/or varying thickness of the lacquer. Further, in comparing coconut oil and liquid paraffin (data not shown) it was seen that coconut oil generally provided somewhat lower friction.

Example 5

Tests were also performed in a full-scale test rig using a wardrobe door with a weight of 8.5 kg and using two sliding members 150 and a sliding surface 140. When applying a lipophilic composition coating comprising 100% Liquid paraffin to the lacquer of the sliding surface 140 the wardrobe door could still be moved back and forth without problems and at still a low friction after 500 000 cycles of reciprocation of the wardrobe door. In a comparative test the same equipment was used, but without any lipophilic composition coating being applied on the lacquer. In the latter case the tests had to be stopped already after less than 30 cycles as the test equipment was about to break down due to rapidly increasing friction between the sliding members 150 and the sliding surface 140 (seizing).

It should be realized that the embodiments described above are not limited by the exact number and dimensions described herein. Extendable tables could be provided using an extendable table sliding system having even more moveable parts. Further, it could also be possible to provide an extendable table where the extendable table sliding system does not form the rims for the table, but instead is a concealed structure arranged underneath the table surface. It would thus be possible to arrange a solitary fixed part being in engagement with a moveable part at least on one side.

Although the present invention has been described above with reference to specific embodiments, it is not intended to be limited to the specific form set forth herein. Rather, the invention is limited only by the accompanying claims.

The invention claimed is:

1. An extendable table sliding system for an extendable table, comprising at least two parts being moveable relative each other and together forming at least a part of the extendable table sliding system, wherein one of said at least two parts comprises at least one sliding surface being coated with a lacquer comprising a resin, wherein said lacquer in turn is at least partly coated with a lipophilic composition coating to provide a slide layer with a lowered friction, wherein the other one of said parts of the extendable table sliding system is provided with at least one sliding member, the interface between the sliding surface and the at least one sliding member forming a linear plain bearing to allow for a relative linear movement of the sliding member along the longitudinal axis of the sliding surface, wherein at least the part of said at least one sliding member being in contact with the sliding surface is made of a plastic.

2. The sliding system according to claim 1, wherein the sliding surface is formed on at least one surface of a C-shaped groove in one of said at least two parts.

3. The sliding system according to claim 2, wherein the C-shaped groove is integrally formed in one of said at least two parts.

4. The sliding system according to claim 1, wherein the sliding surface is formed by an insert received in a recess in one of said at least two parts.

5. The sliding system according to claim 4, wherein the sliding surface is formed by the insert, wherein said part being provided with the recess is made of a material being different from the material of said insert.

6. The sliding system according to claim 5, wherein said material of the part being provided with the recess is a wooden material, or a plastic material.

7. The sliding system according to claim 1, wherein the sliding surface is formed by a member protruding outwards from one of said at least two parts.

8. The sliding system according to claim 1, wherein said sliding surface is formed by at least one of an upper sliding surface, a lower sliding surface, and a distal sliding surface, or any combination thereof.

9. The sliding system according to claim 1 wherein at least the part of said at least one sliding member being in contact with the sliding surface is made of a plastic comprising a polymer with polar groups.

10. The sliding system according to claim 1, wherein at least the part of said at least one sliding member in contact with the sliding surface is made of a plastic comprising a polymer selected from the group of polymers consisting of polyoxymethylenes (POM), polyesters, polyamides (PA), polyvinyl chloride (PVC), polyphenylene sulfide (PPS), polyaryletherketone (PAEK), and Polytetrafluoroethylene (PTFE).

11. The sliding system according to claim 1, wherein said at least one sliding member is in its entirety made from a plastic.

12. The sliding system according to claim 1, wherein the part of said at least one sliding member arranged to slide along the sliding surface comprises at least one blade extending in the sliding direction.

13. The sliding system according to claim 12, wherein said sliding member is provided with at least one blade extending in a first direction from a first surface of the sliding member, and at least one blade extending in a second direction from a second surface of the sliding member, wherein said first and second surfaces are parallel, and wherein said first direction is opposite to said second direction.

14. The sliding system according to claim 12, wherein said sliding member is provided with at least one blade extending in a first direction from a first surface of the sliding member, and at least one blade extending in a third direction from a third surface of the sliding member, wherein said first and third surfaces are non-parallel, and wherein said first direction is perpendicular to said third direction.

15. The sliding system according to claim 1, wherein the at least one sliding member comprises at least one individual contact point in contact with the sliding surface, the contact area of each individual contact point being less than 3 $mm^2$.

16. The sliding system according to claim 1, wherein the thickness of the lacquer coated on the sliding surface is 100 μm or less.

17. The sliding system claim 1, wherein the sliding surface is formed by an aluminum member having a surface onto which the lacquer is applied, and wherein the surface of the aluminum member has been electrophoretically coated with a resin and subsequently heat cured to form the lacquer coated on the sliding surface, and wherein the lipophilic composition coating comprises compounds comprising C6 to C40 non-aromatic hydrocarbyl groups.

18. An extendable table, comprising at least one sliding system according to claim 1 wherein one of said two parts of the extendable table sliding system is fixed to the table, while the other of said at least two parts forms an extendable part of the extendable table sliding system of the table.

19. The extendable table according to claim 18, wherein a table surface is fixedly attached to one of said at least two parts, and wherein optionally an extension table surface is releasably attachable to one of said at least two parts.

20. The extendable table according to claim 1, wherein each one of said two parts comprises two parallel members, and wherein one parallel member of each one of the two parts forms a first sliding system, and the other parallel member of each one of the two parts forms a second sliding system, and wherein optionally the two parallel members of each one of said two parts are fixedly attached to each other by means of at least one transverse beam.

* * * * *